US011787188B2

(12) United States Patent
Watanabe et al.

(10) Patent No.: US 11,787,188 B2
(45) Date of Patent: Oct. 17, 2023

(54) MAINTENANCE APPARATUS, RECORDING APPARATUS, AND CONTROL METHOD

(71) Applicant: CANON KABUSHIKI KAISHA, Tokyo (JP)

(72) Inventors: Hikaru Watanabe, Tokyo (JP); Takuya Hane, Kanagawa (JP); Satoshi Kimura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/533,871

(22) Filed: Nov. 23, 2021

(65) Prior Publication Data

US 2022/0169027 A1 Jun. 2, 2022

(30) Foreign Application Priority Data

Nov. 27, 2020 (JP) ..... 2020-197647

(51) Int. Cl.
*B41J 2/165* (2006.01)

(52) U.S. Cl.
CPC ..... *B41J 2/16552* (2013.01); *B41J 2/16523* (2013.01); *B41J 2002/16558* (2013.01)

(58) Field of Classification Search
CPC ..... B41J 2/16552; B41J 2/16523; B41J 2002/16558
See application file for complete search history.

(56) References Cited

U.S. PATENT DOCUMENTS

| | | | | |
|---|---|---|---|---|
| 2012/0218346 | A1 | 8/2012 | Inoue | |
| 2020/0047502 | A1 | 2/2020 | Saito | |
| 2020/0114647 | A1 * | 4/2020 | Andres | B41J 2/16535 |
| 2021/0245510 | A1 | 8/2021 | Rosenberg | |
| 2021/0309012 | A1 | 10/2021 | Reder | |

FOREIGN PATENT DOCUMENTS

| | | | | |
|---|---|---|---|---|
| CN | 111 016 439 | A | 4/2020 | |
| DE | 20 2019 102598 | U1 | 11/2019 | |
| DE | 10 2019 104579 | A1 | 8/2020 | |
| JP | 2010005856 | A | 1/2010 | |
| JP | 2012171345 | A | 9/2012 | |
| JP | 3222948 | U * | 9/2019 | B41J 2/16526 |
| JP | 2020059188 | A | 4/2020 | |
| WO | 2020/018876 | A1 | 1/2020 | |

* cited by examiner

*Primary Examiner* — Sharon Polk
(74) *Attorney, Agent, or Firm* — Canon U.S.A., Inc. IP Division

(57) ABSTRACT

A maintenance apparatus that prevents a reduction in image quality of an image recorded by a liquid discharge head is provided. A maintenance apparatus includes an application unit configured to come into contact with a discharge surface included in a recording head and apply a cleaning liquid to the discharge surface, wherein discharge ports configured to discharge a liquid are formed on the discharge surface, a suction unit configured to suction the discharge surface, a movement unit configured to move the suction unit relative to the recording head, and a control unit configured to execute a first cleaning mode where, after the application unit applies the cleaning liquid, the suction unit suctions the discharge surface.

18 Claims, 20 Drawing Sheets

MAINTENANCE APPARATUS, RECORDING APPARATUS, AND CONTROL METHOD

BACKGROUND

Field of the Disclosure

The present disclosure relates to a maintenance apparatus that maintains a recording head, a recording apparatus, and a control method.

Description of the Related Art

In a liquid discharge head, if mist or paper dust is attached to the vicinity of discharge ports that discharge a liquid, a discharge failure may occur. Thus, it is necessary to periodically clean the vicinity of the discharge ports and a discharge port surface on which the discharge ports are formed. As a cleaning method of the conventional art, forms are known in which a discharge port surface is wiped with a wiper blade, wiped with a web or a porous body, or cleaned by using a liquid in combination with these methods.

Japanese Patent Application Laid-Open No. 2010-005856 discusses a configuration in which, after a nozzle formation surface to which a cleaning liquid is applied is wiped with a blade, a suction removal unit removes the liquid having entered a gap between head units.

Japanese Patent Application Laid-Open No. 2012-171345 discusses a configuration in which a cleaning liquid collection unit is included that collects an excessive cleaning liquid from a wiping web to which a cleaning liquid is supplied. In the configuration of Japanese Patent Application Laid-Open No. 2010-005856, however, the blade may push the applied cleaning liquid into nozzles. Further, in the configuration of Japanese Patent Application Laid-Open No. 2012-171345, the cleaning liquid collection unit may excessively collect the cleaning liquid, whereby a discharge port surface may not be sufficiently cleaned.

SUMMARY

Some embodiments are directed to providing a maintenance apparatus that prevents a reduction in image quality of an image recorded by a liquid discharge head.

According to an aspect of the present disclosure, a maintenance apparatus includes an application unit configured to come into contact with a discharge surface included in a recording head and apply a cleaning liquid to the discharge surface, wherein discharge ports configured to discharge a liquid are formed on the discharge surface, a suction unit configured to suction the discharge surface, a movement unit configured to move the suction unit relative to the recording head, and a control unit configured to execute a first cleaning mode where, after the application unit applies the cleaning liquid, the suction unit suctions the discharge surface.

Further features of various embodiments will become apparent from the following description of exemplary embodiments with reference to the attached drawings.

BRIEF DESCRIPTION I/F THE DRAWINGS

FIGS. 15A, 15B, 15C, and 15D are diagrams illustrating a detailed configuration of the cap unit of the recording apparatus according to the first exemplary embodiment.

Figure 16:
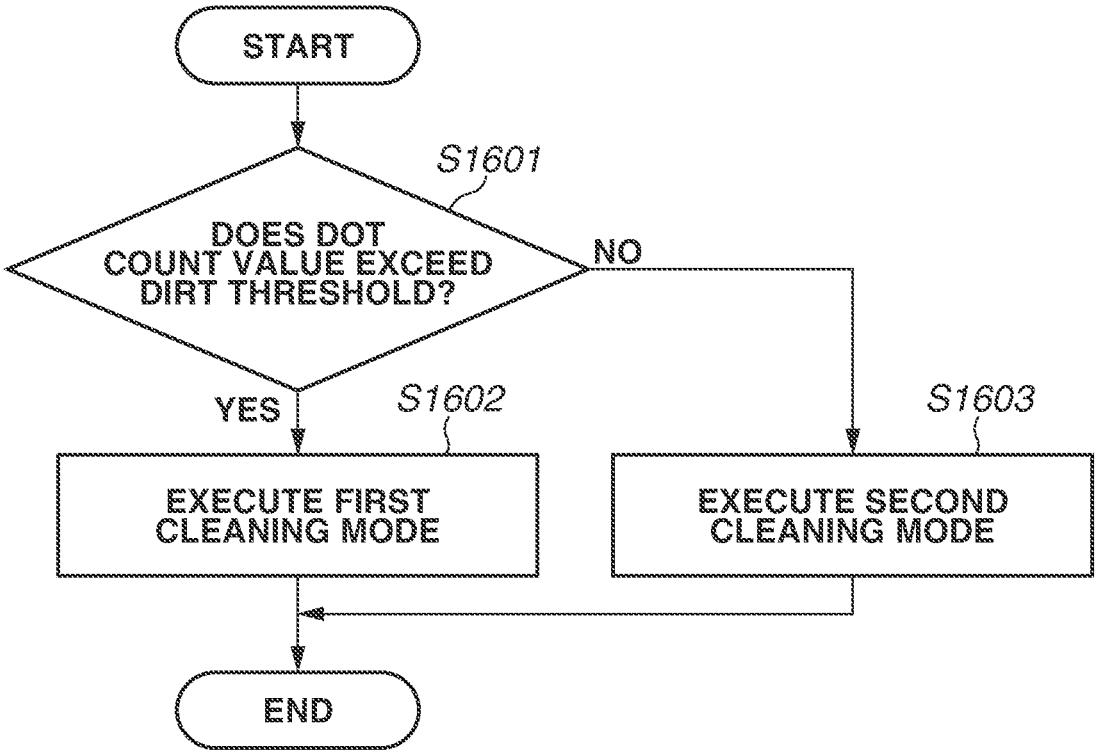

FIG. 16 is a flowchart for selecting a cleaning mode of the recording apparatus according to the first exemplary embodiment.

Figure 17:
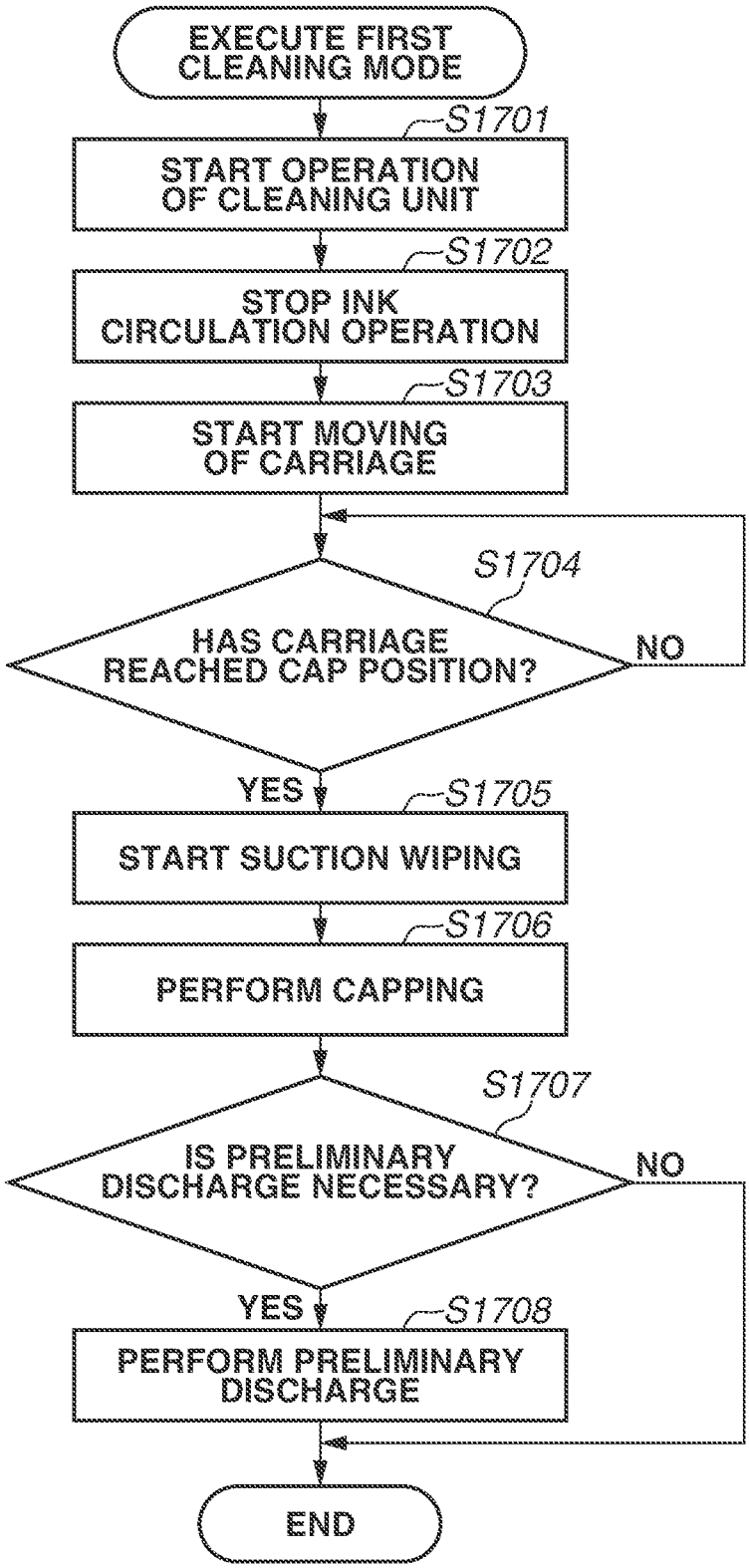

FIG. 17 is a flowchart illustrating a first cleaning mode of the recording apparatus according to the first exemplary embodiment.

Figure 18:
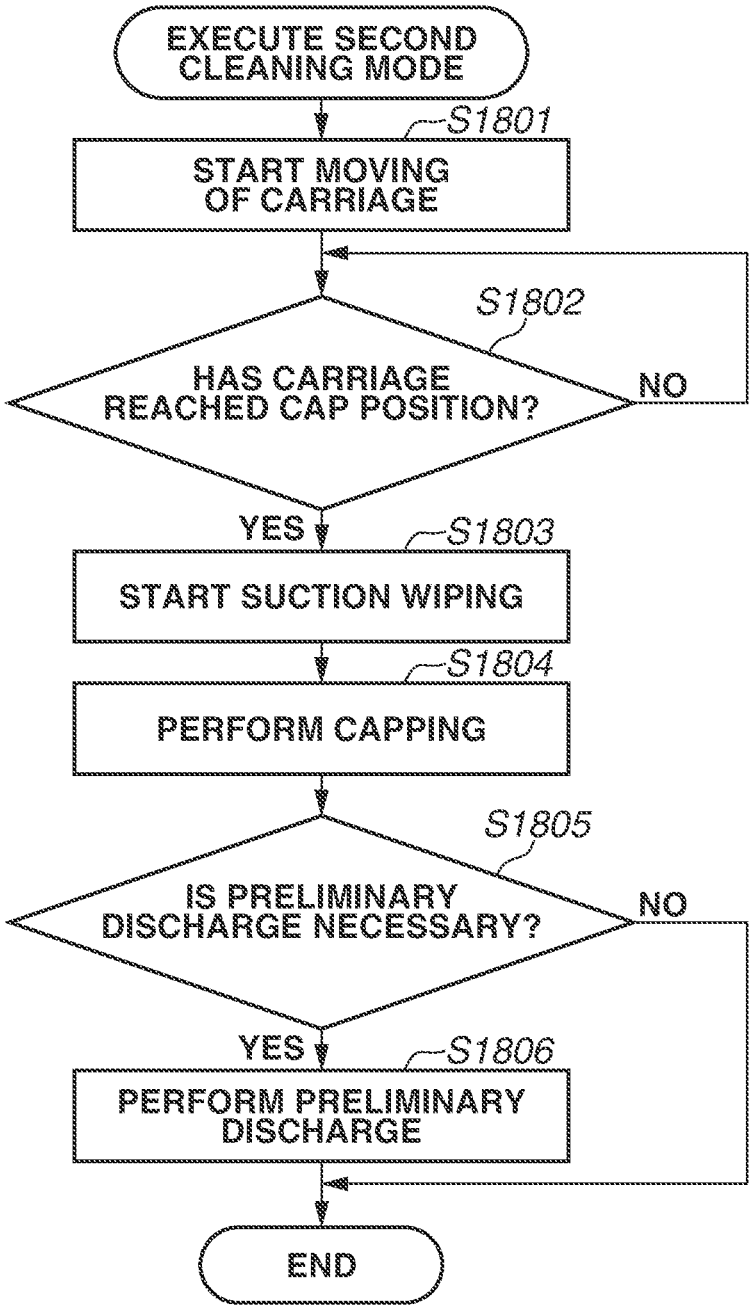

FIG. 18 is a flowchart illustrating a second cleaning mode of the recording apparatus according to the first exemplary embodiment.

Figure 19A:
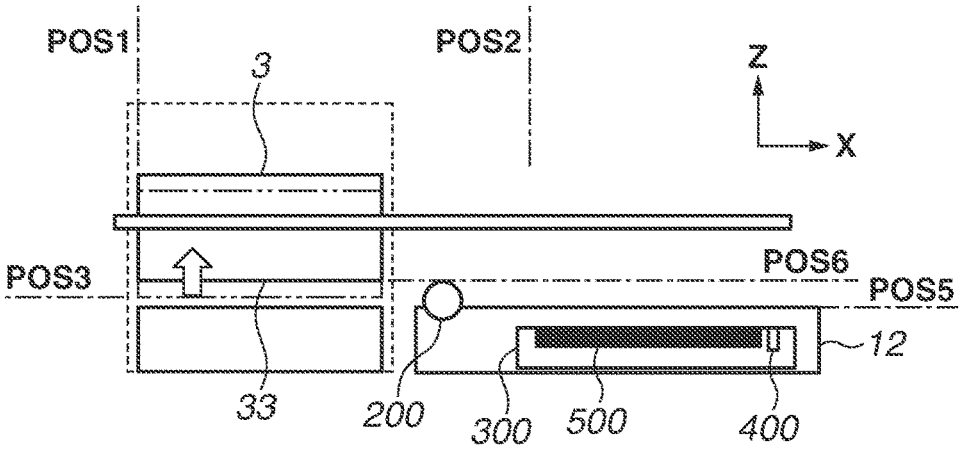
Figure 19B:
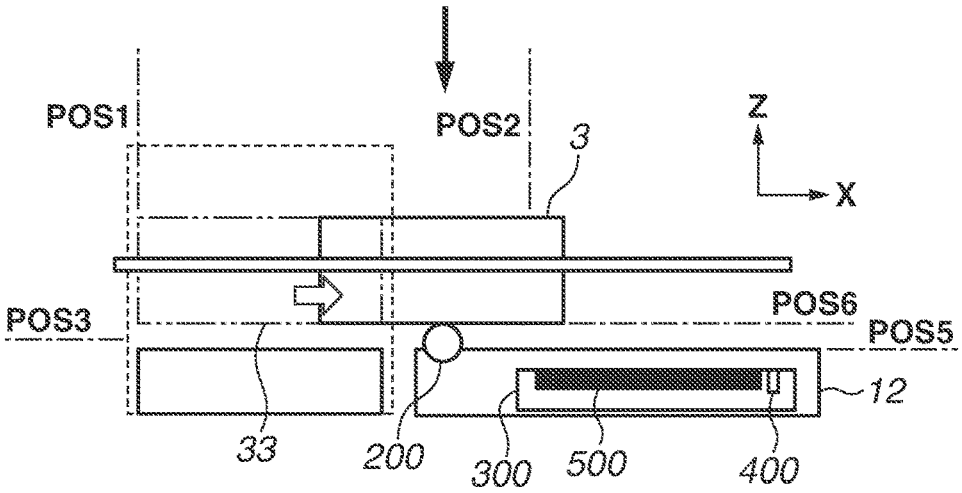
Figure 19C:
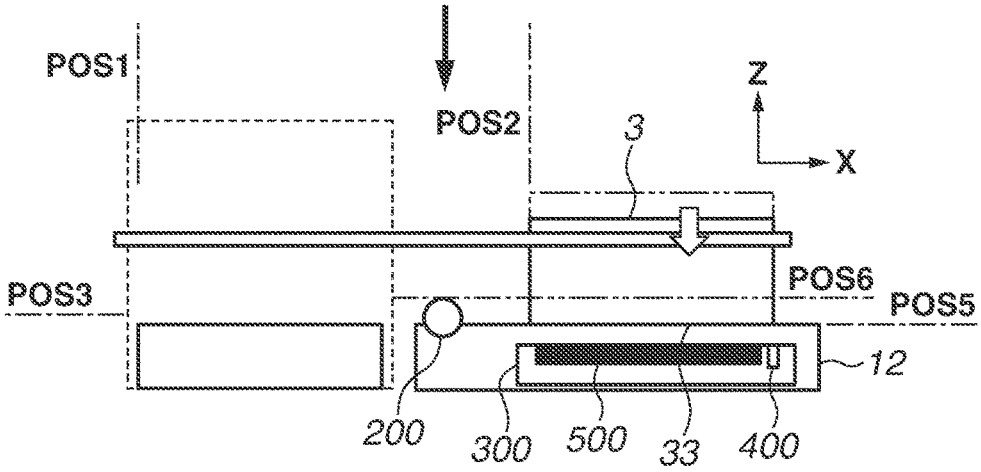

FIGS. 19A, 19B, and 19C are schematic views illustrating a movement of a carriage in the first cleaning mode of the recording apparatus according to the first exemplary embodiment.

FIGS. 20A, 20B, 20C, and 20D are schematic side views illustrating a movement of the suction wiping unit of the recording apparatus according to the first exemplary embodiment.

DESCRIPTION OF THE EMBODIMENTS

Exemplary embodiments will be described below with reference to the drawings. The following exemplary embodiments, however, do not limit every embodiment, and not all the combinations of the features described in the exemplary embodiments are essential to a solving means of every embodiment. The relative arrangement and the shapes of the components described in the exemplary embodiments are merely illustrative, and do not limit the scope of every embodiment to them only. In the drawings, arrows X and Y indicate horizontal directions orthogonal to each other, and an arrow Z indicates a vertical direction.

<Recording System>

Figure 1:
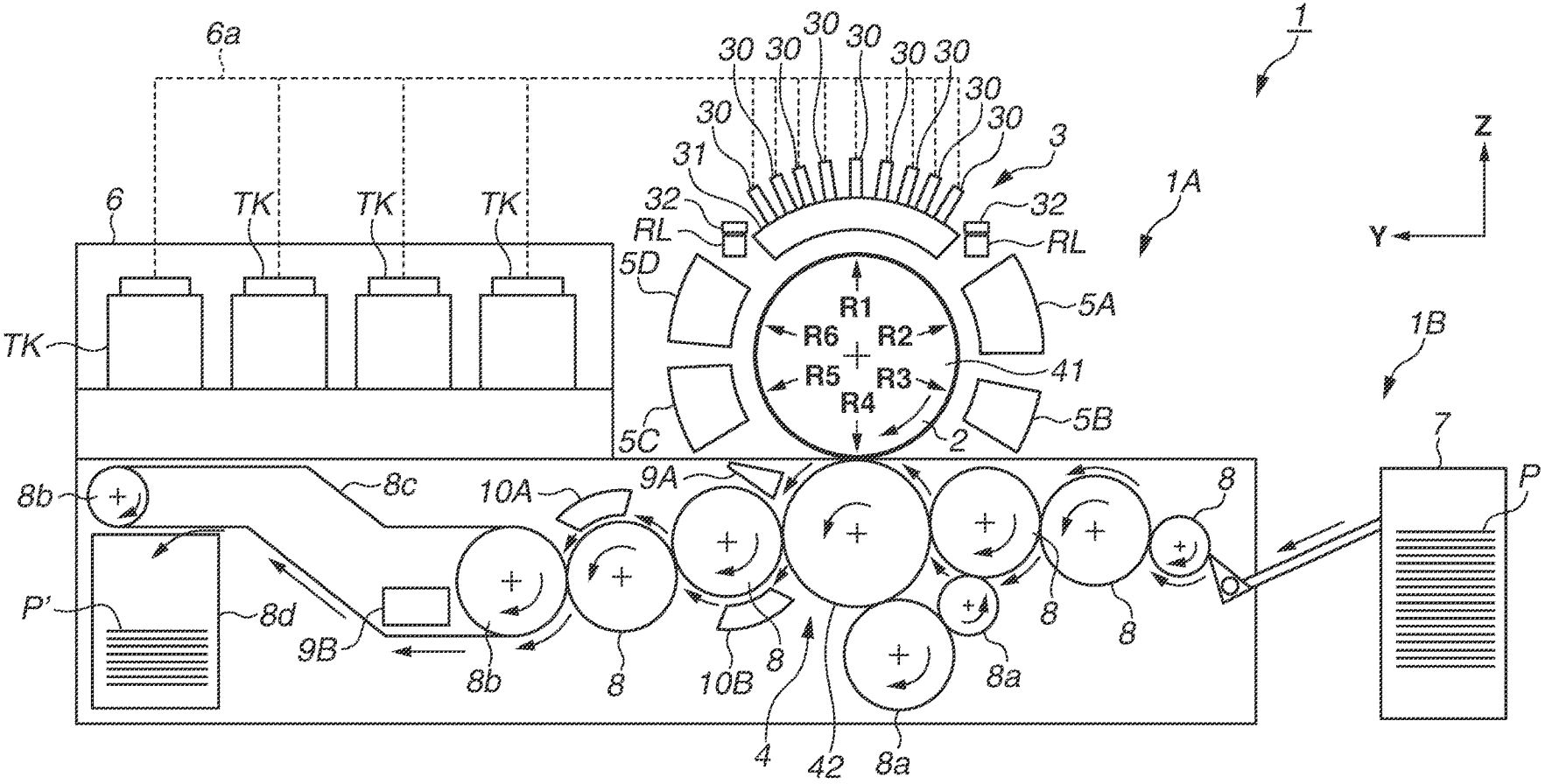
FIG. 1 is an overview diagram of a recording system according to a first exemplary embodiment.

FIG. 1 is a front view schematically illustrating a recording system 1 according to a first exemplary embodiment. The recording system 1 is a sheet-fed inkjet printer (inkjet recording apparatus) that transfers an ink image to a recording medium P via a transfer member 2, thereby producing a recorded product P'. The recording system 1 includes a recording apparatus 1A and a conveying apparatus 1B. In the first exemplary embodiment, an X-direction, a Y-direction, and a Z-direction indicate a depth direction, a width direction (entire length direction) of the recording system 1, and a height direction, respectively. The recording medium P is conveyed in the Y-direction.

"Recording" includes not only a case where meaningful information such as a character or a figure is formed, but also a case where an image, a design, or a pattern is broadly formed on a recording medium, regardless of whether meaningful or meaningless, or a case where a medium is processed. It does not matter whether a recording result is visualized so that a person can visually perceive the recording result. A "recording medium" is assumed to be sheet-like paper in the present exemplary embodiment, but may be cloth or a plastic film.

Components of an ink are not particularly limited. In the present exemplary embodiment, a case is described where an aqueous pigment ink containing a color material, water, and a resin is used.

<Recording Apparatus>

The recording apparatus 1A includes a recording unit 3, a transfer unit 4, peripheral units 5A to 5D, and a supply unit 6.

<Recording Unit>

Figure 2:
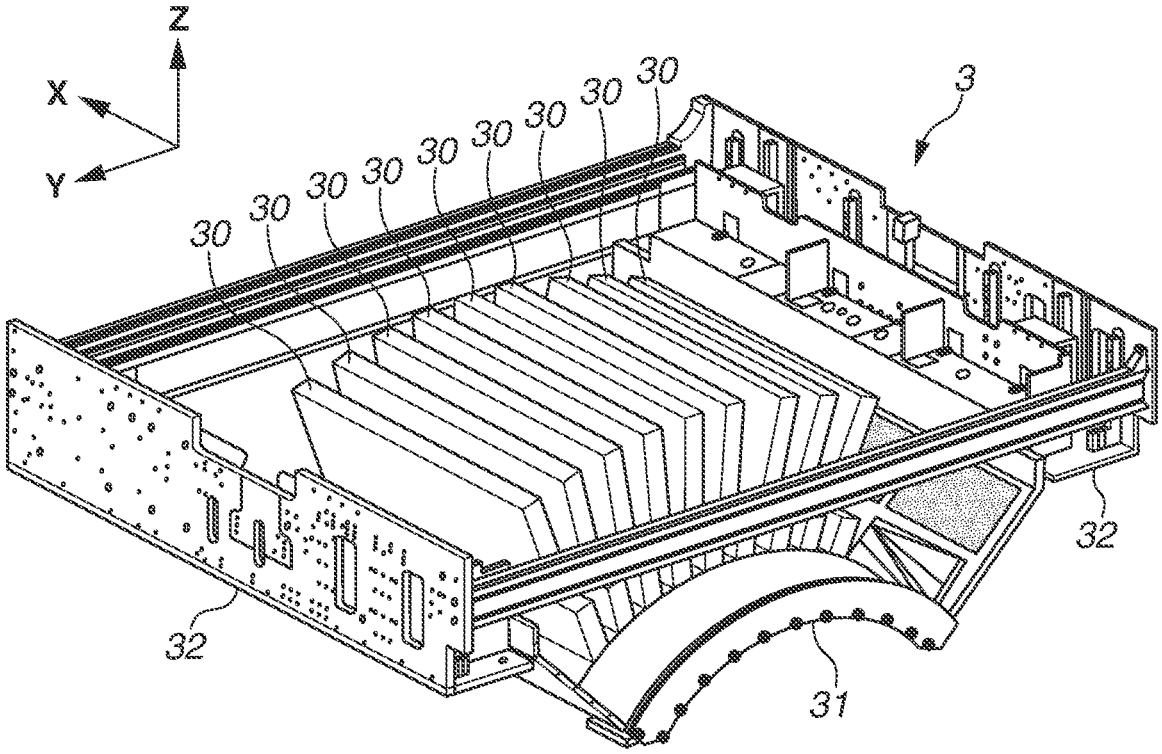
FIG. 2 is a perspective view of a recording unit according to the first exemplary embodiment.

The recording unit 3 includes a plurality of recording heads 30 and a carriage 31. FIGS. 1 and 2 are referenced. FIG. 2 is a perspective view of the recording unit 3. The recording heads 30 discharge liquid inks to the transfer member 2, thereby forming an ink image of a recorded image on the transfer member 2.

In the present exemplary embodiment, each recording head 30 is a full-line recording head extending in the X-direction, and in the recording head 30, nozzles (discharge ports) are arranged in a range corresponding to the width of an image recording region of a recording medium of a maximum size that can be used. The recording head 30 includes, in an end portion thereof, an ink discharge surface on which the nozzles are open. The ink discharge surface faces the surface of the transfer member 2 with a minute gap (of several millimeters) therebetween. In the present exemplary embodiment, the transfer member 2 is configured to cyclically move in a circular orbit, and thus, the plurality of recording heads 30 is radially placed.

In each nozzle, a discharge element is provided. For example, the discharge element is an element that generates pressure in the nozzle, thereby discharging an ink in the nozzle. A technique for an inkjet recording head of a known inkjet printer is applicable to the discharge element. Examples of the discharge element include an element that causes film boiling in an ink and forms air bubbles using an electrothermal conversion member, thereby discharging the ink, an element that discharges an ink using an electromechanical conversion member, and an element that discharges an ink using static electricity. In terms of recording with high density at high speed, the discharge element using the electrothermal conversion member can be used.

In the present exemplary embodiment, nine recording heads 30 are provided. The recording heads 30 discharge inks of different types from each other. The inks of different types are inks of which the color materials are different from each other, and are inks such as a yellow ink, a magenta ink, a cyan ink, and a black ink. Each of the recording heads 30 discharges one type of ink, but may be configured to discharge a plurality of types of ink. In a case where the plurality of recording heads 30 is thus provided, some of the plurality of recording heads 30 may discharge an ink that does not contain a color material (e.g., a clear ink).

The carriage 31 supports the plurality of recording heads 30. An end portion on the ink discharge surface side of each of the recording heads 30 is fixed to the carriage 31. This can maintain the gap between the ink discharge surface and the surface of the transfer member 2 more accurately. The carriage 31 is configured to be capable of being displaced by guidance of guide members RL while the recording heads 30 are mounted on the carriage 31. In the present exemplary embodiment, the guide members RL are rail members extending in the X-direction, and the rail members are provided in a pair while being spaced apart in the Y-direction. In side portions in the X-direction of the carriage 31, slide portions 32 are provided. The slide portions 32 engage with the guide members RL and slide in the X-direction along the guide members RL.

Figure 3:
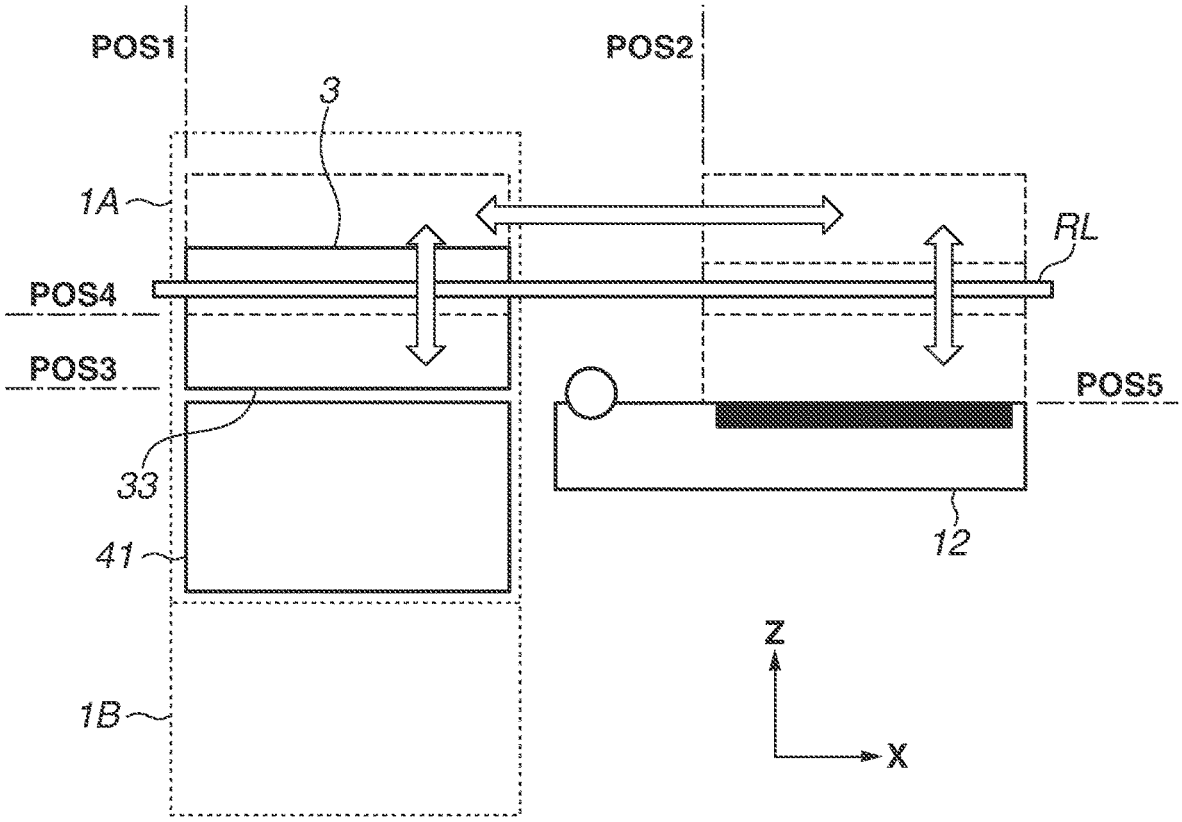
FIG. 3 is a diagram illustrating a displacement form of the recording unit according to the first exemplary embodiment.

FIG. 3 illustrates a displacement form of the recording unit 3 and is a diagram schematically illustrating a right side surface of the recording system 1. In the rear of the recording system 1, a recovery unit 12 is provided. The recovery unit 12 is a mechanism for recovering discharge performance of each recording head 30 and functions as a maintenance device for maintaining the recording head 30. For example, the recovery unit 12 is provided with a cap mechanism for capping an ink discharge surface 33 of the recording head 30, a cleaning mechanism for cleaning the ink discharge surface 33, and a suction mechanism for suctioning ink in the recording head 30 from the ink discharge surface 33 by negative pressure.

The guide members RL extend from the sides of the transfer member 2 to the recovery unit 12. The recording unit 3 can be displaced by the guidance of the guide members RL between a discharge position POS1 where the recording unit 3 is indicated by a solid line, and a cap position POS2 where the recording unit 3 is indicated by a dashed line. The recording unit 3 is moved by a driving mechanism (not illustrated).

Further, the recording unit 3 is configured to be capable of being displaced also in the Z-direction by the guidance of a guide member (not illustrated) to a discharge position POS3, a retracted position POS4, and a cap position POS5, and is moved by a driving mechanism (not illustrated).

A position indicated by the discharge position POS1 in the X-direction and the discharge position POS3 in the Z-direction is a position where the recording unit 3 discharges inks to the transfer member 2, and is a position where the ink discharge surface 33 of the recording head 30 faces the surface of the transfer member 2.

The retracted position POS4 is a position where the recording unit 3 rises from the discharge position POS3 in the Z-direction, and is a position through which the recording unit 3 passes to move to the cap position POS2 immediately above the recovery unit 12. In the state where the recording unit 3 is moved to the retracted position POS4 in the Z-direction, the movement of the recording unit 3 to the cap position POS2 in the X-direction is completed, and then, the recording unit 3 moves down in the Z-direction to the cap position POS5. After the process in which the recording unit 3 moves to the cap positions POS2 and POS5 and completion of the movement of the recording unit 3, the recovery unit 12 performs various recovery operations. The details will be described below.

<Transfer Unit>

With reference to FIG. 1, the transfer unit 4 is described. The transfer unit 4 includes a transfer cylinder 41 and an impression cylinder 42. Each of these cylinders is a rotating body that rotates about a rotating shaft in the X-direction, and has a cylindrical outer circumferential surface. In FIG. 1, arrows illustrated in the figures of the transfer cylinder 41 and the impression cylinder 42 indicate the rotational directions of the transfer cylinder 41 and the impression cylinder 42. The transfer cylinder 41 rotates clockwise, whereas the impression cylinder 42 rotates counterclockwise.

The transfer cylinder 41 is a supporting body that supports the transfer member 2 on the outer circumferential surface thereof. The transfer member 2 is continuously or intermittently provided in the circumferential direction on the outer circumferential surface of the transfer cylinder 41. In a case where the transfer member 2 is continuously provided, the transfer member 2 is formed into an endless belt. In a case where the transfer member 2 is intermittently provided, the transfer member 2 is formed into belts having ends in a plurality of segments, and the segments can be placed at regular pitches in an arc shape on the outer circumferential surface of the transfer cylinder 41.

By rotation of the transfer cylinder 41, the transfer member 2 cyclically moves in a circular orbit. Based on a rotational phase of the transfer cylinder 41, a position on the transfer member 2 can be identified as being in a formation region R1, a transfer preprocessing region (regions R2 and R3), a transfer region R4, a transfer post-processing region R5, and a discharge preprocessing region R6. The transfer member 2 cyclically passes through these regions.

The formation region R1 is a region where the recording unit 3 discharges inks to the transfer member 2, thereby forming an ink image. The transfer preprocessing regions R2 and R3 are processing regions where processing is performed on the ink image before transfer. The transfer preprocessing region R2 is a region where the peripheral unit 5A performs processing. The transfer preprocessing region R3 is a region where the peripheral unit 5B performs processing. The transfer region R4 is a region where the transfer unit 4 transfers the ink image on the transfer member 2 to a recording medium P. The transfer post-processing region R5 is a region where post-processing is performed on the transfer member 2 after the transfer, and is a region where the peripheral unit 5C performs processing. The discharge preprocessing region R6 is a region where preprocessing is performed on the transfer member 2 (a reaction liquid is applied in the present exemplary embodiment) before inks are discharged, and is a region where the peripheral unit 5D performs processing.

In the present exemplary embodiment, the formation region R1 is a region having a certain section, and the other regions R2 to R4 are regions that are substantially points in the view shown in FIG. 1 (in other words, lines in a three-dimensional view). If these regions are likened to a clock face, in the present exemplary embodiment, the formation region R1 is in a range from about 11 o'clock to 1 o'clock, the transfer preprocessing region R2 is at about the 2 o'clock position, the transfer preprocessing region R3 is at about the 4 o'clock position, the transfer region R4 is at about the 6 o'clock position, the transfer post-processing region R5 is at about the 8 o'clock position, and the discharge preprocessing region R6 is at about the 10 o'clock position.

The transfer member 2 may be composed of a single layer, or may be a laminate of a plurality of layers. In a case where the transfer member 2 is composed of the plurality of layers, for example, the transfer member 2 may include three layers, namely a surface layer, an elastic layer, and a compression layer. The surface layer is the outermost layer having an image formation surface on which the ink image is formed. The compression layer is provided to absorb deformation and disperse a local pressure fluctuation. Thus, it is possible to maintain a transfer property even when high speed recording is performed. The elastic layer is a layer between the surface layer and the compression layer.

As a material of the surface layer, various materials, such as a resin and a ceramic, can be appropriately used. In terms of durability, a material having a high compressive elastic modulus can be used. Specifically, examples of the material include an acrylic resin, an acrylic silicone resin, a fluorine-containing resin, and a condensation product obtained by condensing a hydrolyzable organosilicon compound. To improve the wettability of the reaction liquid and the transfer property, the surface layer may be subjected to surface treatment and then used. Examples of the surface treatment include frame treatment, corona treatment, plasma treatment, polishing treatment, roughening treatment, active energy ray irradiation treatment, ozone treatment, surfactant treatment, and silane coupling treatment. A plurality of types of treatment may be combined together. Further, a surface shape may be provided on the surface layer.

Examples of a material of the compression layer include acrylonitrile butadiene rubber, acrylic rubber, chloroprene rubber, urethane rubber, and silicone rubber. When such a rubber material is molded, a predetermined amount of a vulcanizing agent or a vulcanization accelerator may be blended, and a filler, such as a foaming agent, hollow fine particles, or salt, may be further blended as needed, thereby obtaining a porous rubber material. Consequently, an air bubble portion is compressed with a change in volume in response to various pressure fluctuations, and thus, deformation in a direction other than a compression direction is small. Thus, a more stable transfer property and more stable durability can be obtained. Examples of the porous rubber material include a material having a continuous pore structure where pores are continuous with each other, and a material having a closed pore structure where pores are independent of each other. Either of the structures may be used, and the structures may also be used in combination.

As a material of the elastic layer, various materials, such as a resin and a ceramic, can be appropriately used. In terms of processing characteristics, various elastomer materials and rubber materials can be used. Specifically, examples of the material include fluorosilicone rubber, phenyl silicone rubber, fluoro rubber, chloroprene rubber, urethane rubber, and nitrile rubber. Examples of the material also include ethylene propylene rubber, natural rubber, styrene rubber, isoprene rubber, butadiene rubber, a copolymer of ethylene, propylene, and butadiene, and nitrile butadiene rubber. Particularly, silicone rubber, fluorosilicone rubber, and phenyl silicone rubber have a small compression set and thus are advantageous in terms of dimensional stability and durability. The elastic moduli of these types of rubber change little due to temperature, and thus, these types of rubber are advantageous also in terms of the transfer property.

Between the surface layer and the elastic layer and between the elastic layer and the compression layer, various adhesives or double-sided tapes can also be used to fix these layers. The transfer member 2 may also include a reinforcement layer having a high compressive elastic modulus to prevent lateral extension when the transfer member 2 is attached to the transfer cylinder 41 and to maintain firmness. A woven fabric may be used as the reinforcement layer. The transfer member 2 can be produced by freely combining layers made of the above materials.

The outer circumferential surface of the impression cylinder 42 is brought into pressure contact with the transfer member 2. On the outer circumferential surface of the impression cylinder 42, at least one grip mechanism for holding a leading end of the recording medium P is provided. A plurality of grip mechanisms may be provided spaced apart from each other in the circumferential direction of the impression cylinder 42. While the recording medium P is conveyed in close contact with the outer circumferential surface of the impression cylinder 42, the ink image on the transfer member 2 is transferred to the recording medium P when the recording medium P passes through a nip portion between the impression cylinder 42 and the transfer member 2.

<Peripheral Units>

The peripheral units 5A to 5D are placed around the transfer cylinder 41. In the present exemplary embodiment, the peripheral units 5A to 5D are an absorption unit, a heating unit, a cleaning unit, and an application unit, respectively.

The absorption unit 5A is a mechanism for absorbing liquid from an ink image on the transfer member 2 before transfer, and in the present exemplary embodiment in particular, is a mechanism for absorbing moisture from the ink image. By reducing the moisture in the ink image, it is possible to prevent the bleeding of an image recorded on the recording medium P. For example, the absorption unit 5A includes an absorption member that comes into contact with the ink image and reduces the amount of moisture in the ink image. The absorption member may be formed on the outer circumferential surface of a roller, or may be formed into an endless sheet and cyclically run. In terms of protection of the ink image, the absorption member may move in synchronization with the transfer member 2, and a moving velocity of the absorption member may be the same as a circumferential velocity of the transfer member 2. The absorption member may include a porous body that comes into contact with the ink image. To prevent attachment of an ink solid content to the porous body, the average pore diameter of the porous body may be 10 μm or less.

The heating unit 5B is a mechanism for heating the ink image on the transfer member 2 before the transfer. The ink image is heated, whereby a resin in the ink image melts, and a film of the ink image is formed. This improves the transfer property of the ink image to the recording medium P. The heating temperature can be the minimum film forming temperature (MFT) or more of the resin. The MFT can be measured by a generally known technique, such as by using an apparatus compliant with JIS K 6828-2:2003 or ISO2115:1996. In terms of the transfer property and fastness of the image, the ink image may be heated at a temperature higher by 10° C. or more than the MFT, and may further be heated at a temperature higher by 20° C. or more than the MFT. As the heating unit 5B, a known heating device, such as various lamps (e.g., an infrared lamp, or a hot air fan), can be used. In terms of heating efficiency, an infrared heater can be used.

The cleaning unit 5C is a mechanism for cleaning the transfer member 2 after the transfer. The cleaning unit 5C removes ink remaining on the transfer member 2 and dust (e.g., paper dust) on the transfer member 2. The cleaning unit 5C can appropriately use a known method, such as a method for bringing a porous member into contact with the transfer member 2, a method for rubbing a surface of the transfer member 2 with a brush, or a method for scraping a surface of the transfer member 2 with a blade. As the shape of a cleaning member used for the cleaning, a known shape, such as a roller shape or a web shape, can be used.

The application unit 5D is a mechanism for applying a reaction liquid onto the transfer member 2 after the cleaning unit 5C cleans the transfer member 2 and before the recording unit 3 discharges inks. The reaction liquid is a liquid that promotes coagulation of a color material. For example, the reaction liquid contains an ink viscosity increasing component. The ink viscosity increasing component may be a metal ion or a polymer coagulant, and is not particularly limited. As the ink viscosity increasing component, a substance that causes a pH change in an ink and coagulation of the color material in the ink can be used. Specifically, an organic acid can be used.

Examples of the mechanism for applying the reaction liquid include a roller, a recording head, a die coating device (a die coater), and a blade coating device (a blade coater). The reaction liquid is applied to the transfer member 2 before inks are discharged to the transfer member 2, whereby it is possible to prevent bleeding in which adjacent inks are mixed together, and beading in which an ink having landed on the transfer member 2 earlier is drawn by an ink having landed on the transfer member 2 later.

As described above, in the present exemplary embodiment, the absorption unit 5A, the heating unit 5B, the cleaning unit 5C, and the application unit 5D are included as the peripheral units. Alternatively, a cooling function of the transfer member 2 may be provided to some of the units, or a cooling unit may be added. In the present exemplary embodiment, the heat of the heating unit 5B may raise the temperature of the transfer member 2. After the recording unit 3 discharges inks to the transfer member 2, if the ink image exceeds the boiling point of water, which is a main solvent of the inks, the moisture absorption performance of the absorption unit 5A may decrease. The transfer member 2 is cooled so that the discharged inks are maintained at less than the boiling point of water, whereby it is possible to maintain the moisture absorption performance.

The cooling unit may be a blower mechanism for sending air to the transfer member 2 or a mechanism for bringing a member (e.g., a roller) into contact with the transfer member 2 while the member is cooled by air cooling or water cooling. Alternatively, the cooling unit may be a mechanism for cooling the cleaning member of the cleaning unit 5C. The cooling timing may be a period after transfer and before application of the reaction liquid.

<Supply Unit>

The supply unit 6 is a mechanism for supplying inks to the recording heads 30 of the recording unit 3. The supply unit 6 may be provided on the rear side of the recording system 1. The supply unit 6 includes storage portions TK that each store an ink of different type. Each of the storage portions TK may include a main tank and a sub-tank. The storage portion TK and the corresponding recording head 30 communicate with each other via a flow path 6*a*, and the storage portion TK supplies an ink to the recording head 30.

The flow path 6*a* may be a flow path for circulating an ink between the storage portion TK and the recording head 30, and the supply unit 6 may include a pump that circulates the ink. In the middle of the flow path 6*a* or in the storage portion TK, a deaeration mechanism for removing air bubbles in an ink may be provided. In the middle of the flow path 6*a* or in the storage portion TK, a valve for making an adjustment between fluid pressure of an ink and atmospheric pressure may be provided. The heights in the Z-direction of the storage portion TK and the recording head 30 may be designed so that an ink liquid surface in the storage portion TK is at a position lower than a position of the ink discharge surface 33 of the recording head 30.

<Conveying Apparatus>

The conveying apparatus 1B is an apparatus that feeds a recording medium P to the transfer unit 4 and discharges, from the transfer unit 4, a recorded product P' to which an ink image is transferred. The conveying apparatus 1B includes a feeding unit 7, a plurality of conveying cylinders 8 and 8*a*, two sprockets 8*b*, a chain 8*c*, and a collection unit 8*d*. In FIG. 1, an arrow inside the figure of each component of the conveying apparatus 1B indicates the rotational direction of the component, and arrows outside the figures of the components indicate a conveying path of the recording medium P or the recorded product P'. The recording medium P is conveyed from the feeding unit 7 to the transfer unit 4, and the recorded product P' is conveyed from the transfer unit 4 to the collection unit 8*d*. In the conveying direction, a feeding unit 7 side may be referred to as an upstream side, and a collection unit 8*d* side may be referred to as a downstream.

The feeding unit 7 includes a stacking portion in which a plurality of recording media P is stacked, and also includes a feeding mechanism for feeding the recording media P one by one from the stacking portion to the most upstream conveying cylinder 8. Each of the conveying cylinders 8 and 8*a* is a rotating body that rotates about a rotating shaft in the X-direction, and includes a cylindrical outer circumferential surface. On the outer circumferential surface of each of the conveying cylinders 8 and 8*a*, at least one grip mechanism for holding a leading end of the recording medium P (or the recorded product P') is provided. A gripping operation and a release operation of the grip mechanism are controlled so that the recording medium P is received and delivered between the adjacent conveying cylinders.

The two conveying cylinders 8*a* are conveying cylinders for reversing the recording medium P. In the case of one-sided recording, the conveying cylinders 8*a* are not used to convey the recording medium P. In a case where two-sided recording is performed on the recording medium P, after an image is transferred to the front side of the recording medium P, the impression cylinder 42 delivers the recording medium P to the conveying cylinders 8*a* without delivering the recording medium P to the conveying cylinder 8 adjacent to and downstream of the impression cylinder 42. The front and back sides of the recording medium P are reversed via the two conveying cylinders 8*a*, and the recording medium P is delivered to the impression cylinder 42 again via the conveying cylinder 8 upstream of the impression cylinder 42. Consequently, the back side of the recording medium P faces the transfer cylinder 41, and an ink image is transferred to the back side.

The chain 8*c* is wound around the two sprockets 8*b*. One of the two sprockets 8*b* is a driving sprocket, and the other is a driven sprocket. Rotation of the driving sprocket cyclically runs the chain 8*c*. In the chain 8*c*, a plurality of grip mechanisms is provided spaced apart from each other in the longitudinal direction of the chain 8*c*. The grip mechanisms grip an end portion of the recorded product P'. The recorded product P' is delivered from the conveying cylinder 8 located at the downstream end to the grip mechanisms of the chain 8*c*. The recorded product P' gripped by the grip mechanisms is conveyed to the collection unit 8*d* by the running of the chain 8*c*, and the gripping is released. Thus, the recorded product P' is stacked in the collection unit 8*d*.

<Post-Processing Units>

In the conveying apparatus 1B, post-processing units 10A and 10B are provided. The post-processing units 10A and 10B are placed downstream of the transfer unit 4 and are mechanisms for performing post-processing on a recorded product P'. The post-processing unit 10A performs processing on the front side of the recorded product P', and the post-processing unit 10B performs processing on the back side of the recorded product P'. An example of the processing is coating of an image recording surface of the recorded product P' for the purpose of protecting or glossing the image. Examples of the coating include application of a liquid, adhesion of a sheet, and lamination.

<Inspection Unit>

In the conveying apparatus 1B, inspection units 9A and 9B are provided. The inspection units 9A and 9B are placed downstream of the transfer unit 4 and are mechanisms for inspecting the recorded product P'.

In the present exemplary embodiment, the inspection unit 9A is an imaging apparatus that captures an image recorded on the recorded product P'. The inspection unit 9A includes an image sensor, such as a charge-coupled device (CCD) sensor or a complementary metal-oxide-semiconductor (CMOS) sensor. The inspection unit 9A captures the recorded image while a recording operation is continuously performed. Based on the image captured by the inspection unit 9A, the inspection unit 9A can confirm a change over time in color of the recorded image and determine whether recording data can be corrected. In the present exemplary embodiment, an image capturing range of the inspection unit 9A is set to the outer circumferential surface of the impression cylinder 42, and the inspection unit 9A is placed so that the recorded image immediately after transfer can be partially captured. The inspection unit 9A may inspect all recorded images, or may inspect every predetermined number of recorded images.

In the present exemplary embodiment, the inspection unit 9B is also an imaging apparatus that captures an image recorded on the recorded product P'. The inspection unit 9B includes an image sensor, such as a CCD sensor or a CMOS sensor. The inspection unit 9B captures the recorded image in a test recording operation. The inspection unit 9B captures the entire recorded image, and based on the image captured by the inspection unit 9B, the inspection unit 9B can make basic settings of various corrections regarding the recording data. In the present exemplary embodiment, the inspection unit 9B is placed at a position where the inspection unit 9B can capture the recorded product P' conveyed by the chain 8*c*. In a case where the inspection unit 9B captures the recorded image, the running of the chain 8*c* is temporarily stopped, and the inspection unit 9B captures the entire recorded image. The inspection unit 9B may be a scanner that scans the recorded product P'.

<Control Units>

Figure 4:
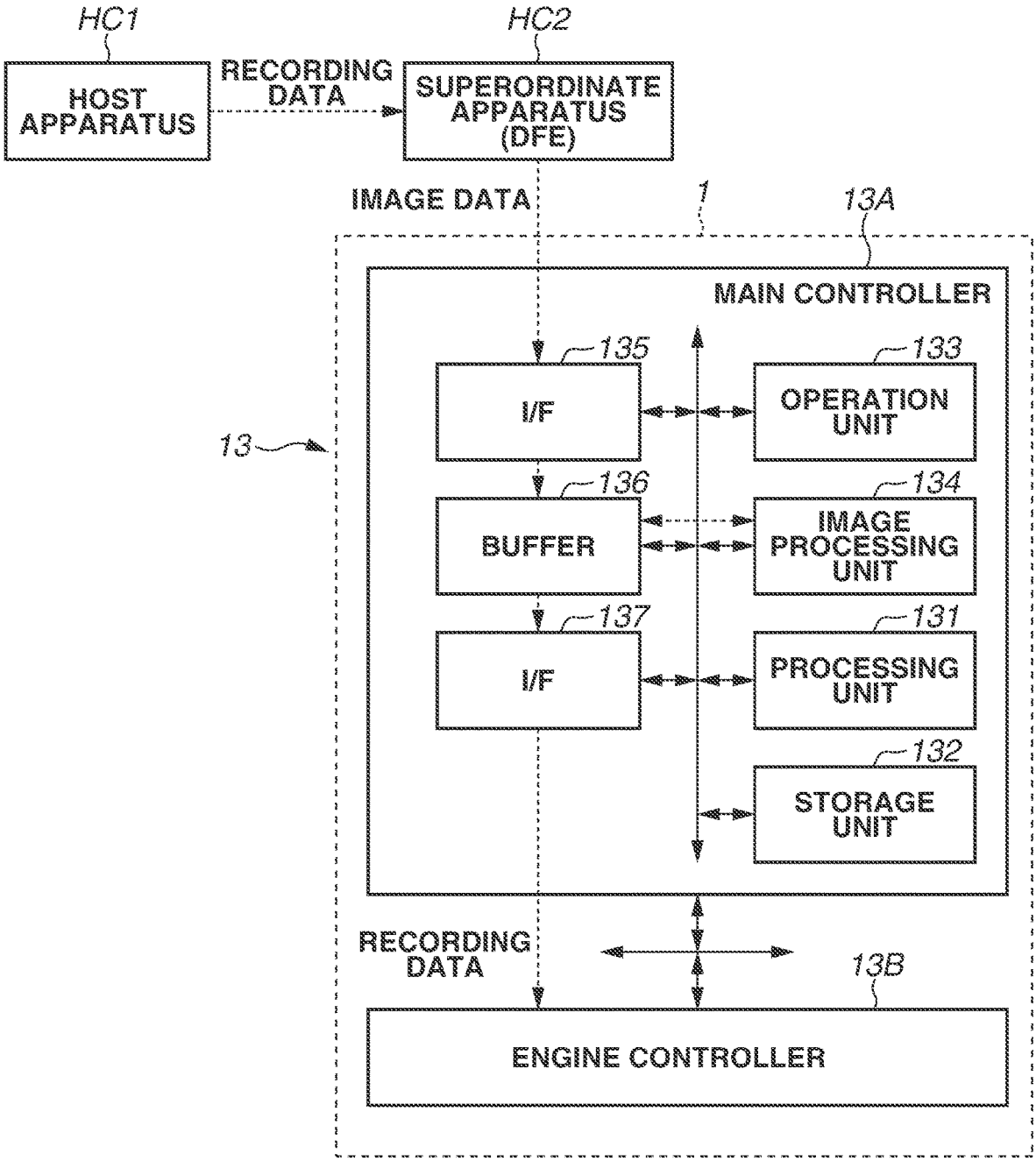
FIG. 4 is a block diagram of a control system of the recording system according to the first exemplary embodiment.
Figure 5:
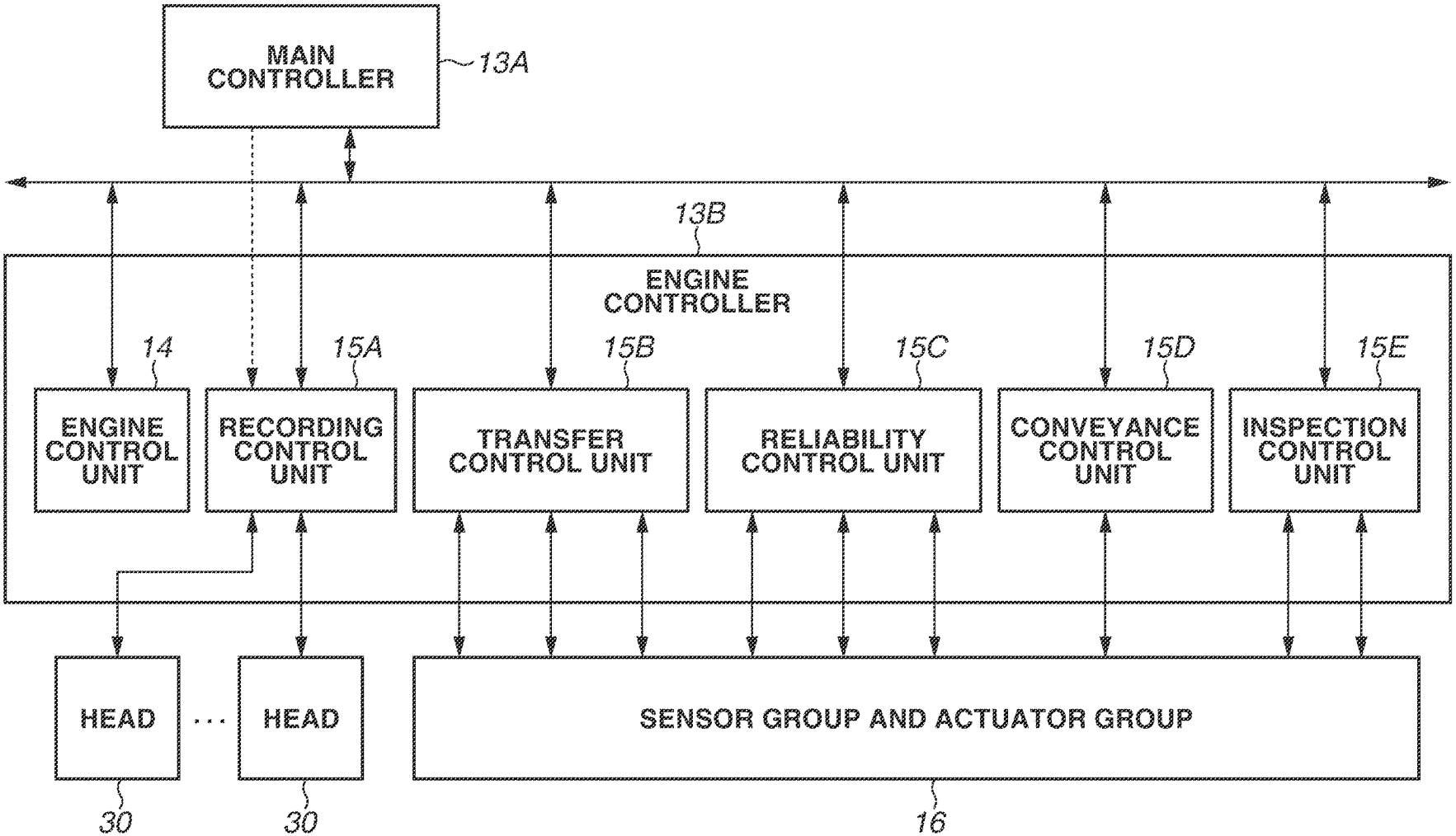
FIG. 5 is a block diagram of the control system of the recording system according to the first exemplary embodiment.

Next, control units of the recording system 1 are described. FIGS. 4 and 5 are block diagrams illustrating a control unit 13 of the recording system 1. The control unit 13 is connected to a superordinate apparatus (e.g., digital front end (DFE)) HC2 so that the control unit 13 can communicate with the superordinate apparatus HC2. The superordinate apparatus HC2 is connected to a host apparatus HC1 so that the superordinate apparatus HC2 can communicate with the host apparatus HC1.

The host apparatus HC1 generates recording data from which a recorded image is generated. The recording data is generated in a format of an electronic file, such as a document file or an image file. The recording data is transmitted to the superordinate apparatus HC2, and the superordinate apparatus HC2 converts the received recording data into a data format (e.g., data of cyan, magenta, yellow, and black (CMYK) colors) that can be used by the control unit 13. The converted recording data is transmitted from the superordinate apparatus HC2 to the control unit 13, and based on the recording data received by the control unit 13, the control unit 13 starts the recording operation.

In the present exemplary embodiment, the control unit 13 is roughly divided into a main controller 13A and an engine controller 13B. The main controller 13A includes a processing unit 131, a storage unit 132, an operation unit 133, an image processing unit 134, a communication interface (I/F) 135, a buffer 136, and a communication I/F 137.

The processing unit 131 is a processor such as a central processing unit (CPU). The processing unit 131 executes a program stored in the storage unit 132 and controls the entire main controller 13A. The storage unit 132 is a storage device, such as a random-access memory (RAM), a read-only memory (ROM), a hard disk, or a solid-state drive (SSD). The storage unit 132 stores a program to be executed by the CPU 131 and data and provides a work area to the CPU 131. The operation unit 133 is an input device, such as a touch panel, a keyboard, or a mouse, and receives an instruction from a user.

For example, the image processing unit 134 is an electronic circuit including an image processing processor. The buffer 136 is a RAM, a hard disk, or an SSD, for example. The communication I/F 135 communicates with the superordinate apparatus HC2. The communication I/F 137 communicates with the engine controller 13B. In FIG. 4, a dashed arrow indicates an example of a processing procedure of recording data. The recording data received from the superordinate apparatus HC2 via the communication I/F 135 is accumulated in the buffer 136. The image processing unit 134 reads the recording data from the buffer 136, performs predetermined image processing on the read recording data, and stores the recording data in the buffer 136 again. The recording data subjected to the image processing and stored in the buffer 136 is transmitted from the communication I/F 137 to the engine controller 13B.

As illustrated in FIG. 5, the engine controller 13B includes control units 14 and 15A to 15E. The engine controller 13B acquires detection results of a sensor group and actuator group 16 included in the recording system 1 and controls driving of the sensor group and actuator group 16. Each of the control units 14 and 15A to 15E includes a processor such as a CPU, a storage device such as a RAM or a ROM, and an interface with an external device. Divisions of the control units are merely examples, and part of control may be executed by a plurality of subdivided control units. Conversely, a configuration may be employed in which a plurality of control units is integrated together and the control contents of the plurality of control units are performed by a single control unit.

The engine control unit 14 controls the entire engine controller 13B. The recording control unit 15A converts recording data received from the main controller 13A into a data format suitable for driving the recording heads 30, such as raster data. The recording control unit 15A controls discharge of each recording head 30.

The transfer control unit 15B controls the absorption unit 5A, the heating unit 5B, the cleaning unit 5C, and the application unit 5D.

The reliability control unit 15C controls the supply unit 6 and the recovery unit 12, and controls the driving mechanism for moving the recording unit 3 between the discharge position POS1 and the recovery position (cap position) POS2.

The conveyance control unit 15D controls the conveying apparatus 1B. The inspection control unit 15E controls the inspection unit 9B and the inspection unit 9A.

In the sensor group and actuator group 16, the sensor group includes a sensor that detects a position and a velocity of a movable portion, a sensor that detects temperature, and an image sensor. The actuator group includes a motor, an electromagnetic solenoid, and an electromagnetic valve.

<Example of Operation>

Figure 6:
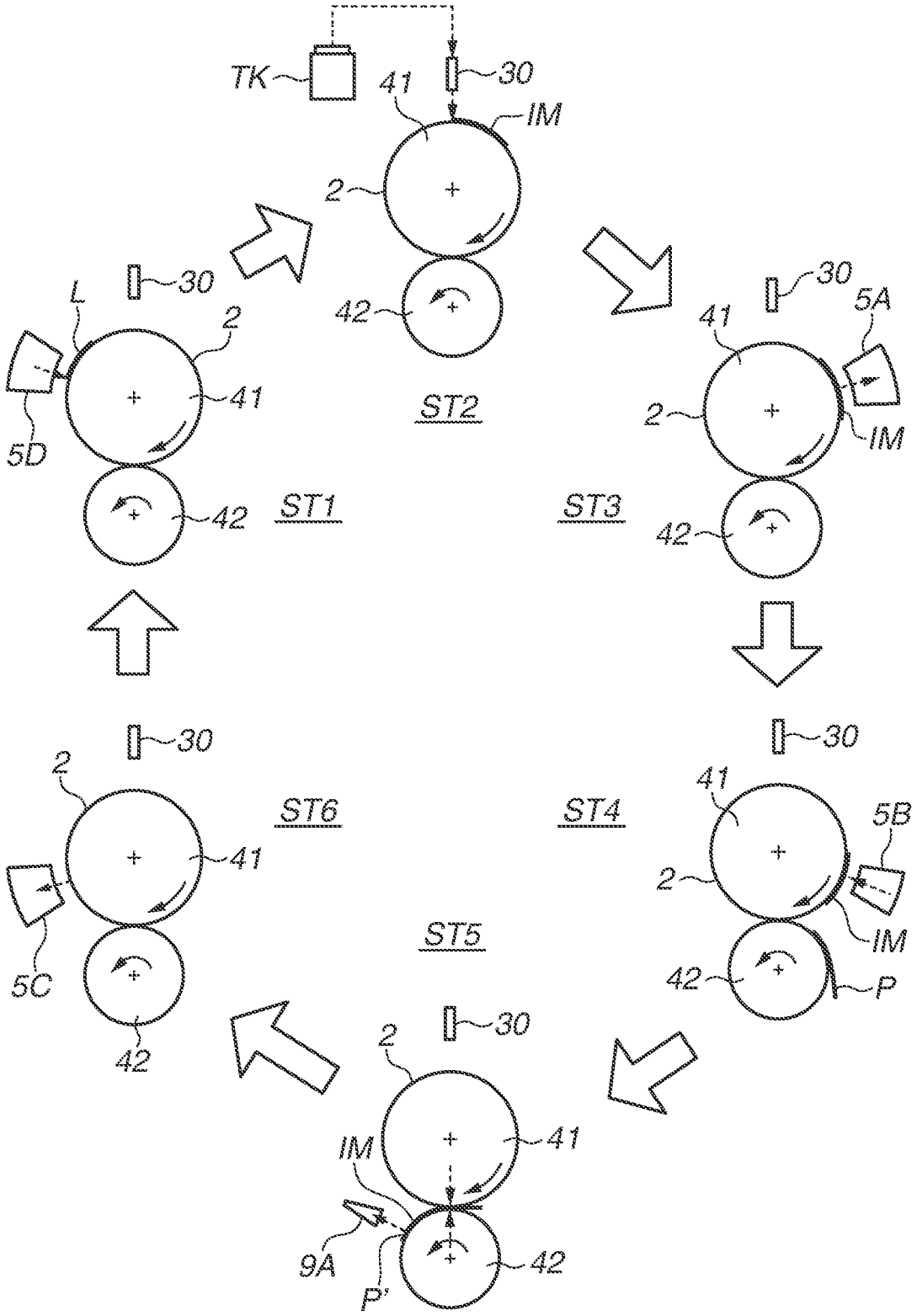
FIG. 6 is a diagram illustrating an example of an operation of the recording system according to the first exemplary embodiment.

FIG. 6 is a diagram schematically illustrating an example of a recording operation. While the transfer cylinder 41 and the impression cylinder 42 are rotated, the following operations are cyclically performed. As illustrated in a state ST1, first, the application unit 5D applies a reaction liquid L onto the transfer member 2. A region on the transfer member 2 to which the reaction liquid L is applied moves with the rotation of the transfer cylinder 41. If the region to which the reaction liquid L is applied reaches below the recording head 30, then as illustrated in a state ST2, the recording head 30 discharges an ink to the transfer member 2. Thus, an ink image IM is formed. At this time, the discharged ink is mixed with the reaction liquid L on the transfer member 2, thereby accelerating the coagulation of a color material. The discharged ink is supplied from one of the storage portions TK of the supply unit 6 to the recording head 30.

The ink image IM on the transfer member 2 moves with the rotation of the transfer member 2. If the ink image IM reaches the absorption unit 5A, then as illustrated in a state ST3, the absorption unit 5A absorbs moisture from the ink image IM. If the ink image IM reaches the heating unit 5B, then as illustrated in a state ST4, the heating unit 5B heats the ink image IM, a resin in the ink image IM melts, and a film of the ink image IM is formed. In synchronization with such formation of the ink image IM, a recording medium P is conveyed by the conveying apparatus 1B.

As illustrated in a state ST5, the ink image IM and the recording medium P reach the nip portion between the transfer member 2 and the impression cylinder 42, and the ink image IM is transferred to the recording medium P, thereby a recorded product P' is produced. If the recorded product P' passes through the nip portion, an image recorded on the recorded product P' is captured by the inspection unit 9A, and the recorded image is inspected. The recorded product P' is conveyed to the collection unit 8*d* by the conveying apparatus 1B.

If a portion on the transfer member 2 where the ink image IM has been formed reaches the cleaning unit 5C, then as illustrated in a state ST6, the portion is cleaned by the cleaning unit 5C. After the cleaning, the transfer member 2 completes one rotation. By a similar procedure, an ink image IM is repeatedly transferred to a recording medium P. In the above description, to facilitate understanding, the description has been given where an ink image IM is transferred to one recording medium P once in one rotation of the transfer member 2. An ink image IM, however, can be successively transferred to a plurality of recording media P in one rotation of the transfer member 2.

Figure 7:
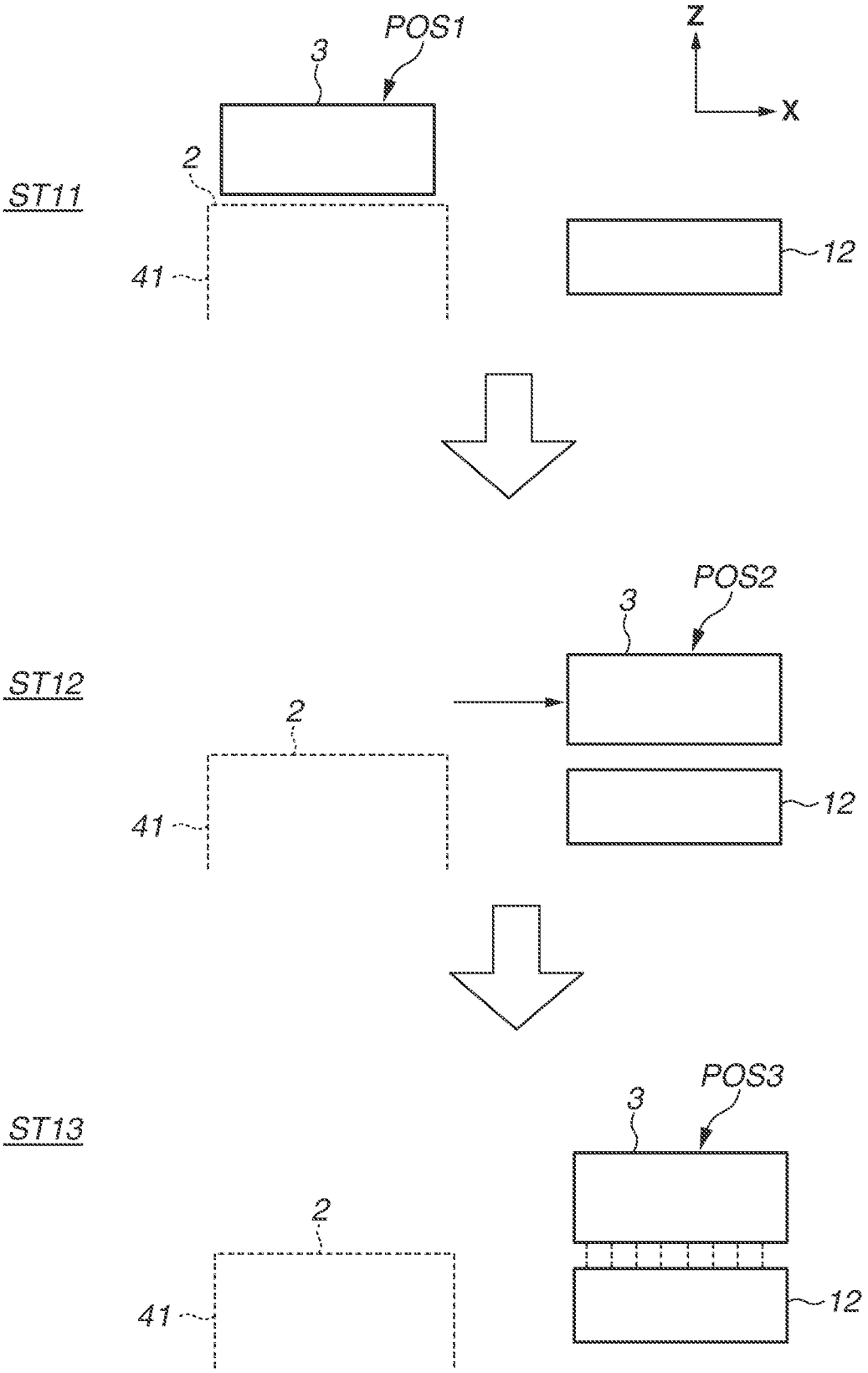
FIG. 7 is a diagram illustrating an example of an operation of the recording system according to the first exemplary embodiment.

If such a recording operation is continued, it is necessary to clean the recording heads 30. FIG. 7 illustrates an example of an operation when the recording heads 30 are cleaned. A state ST11 illustrates the state where the recording unit 3 is located at the discharge position POS1. A state ST12 illustrates the state where the recording unit 3 is displaced to the recovery position POS2. Then, as illustrated in a state ST13, the recovery unit 12 executes the processing of recovering the performance of the recording heads 30 of the recording unit 3.

<Recovery Unit>

Figure 8:
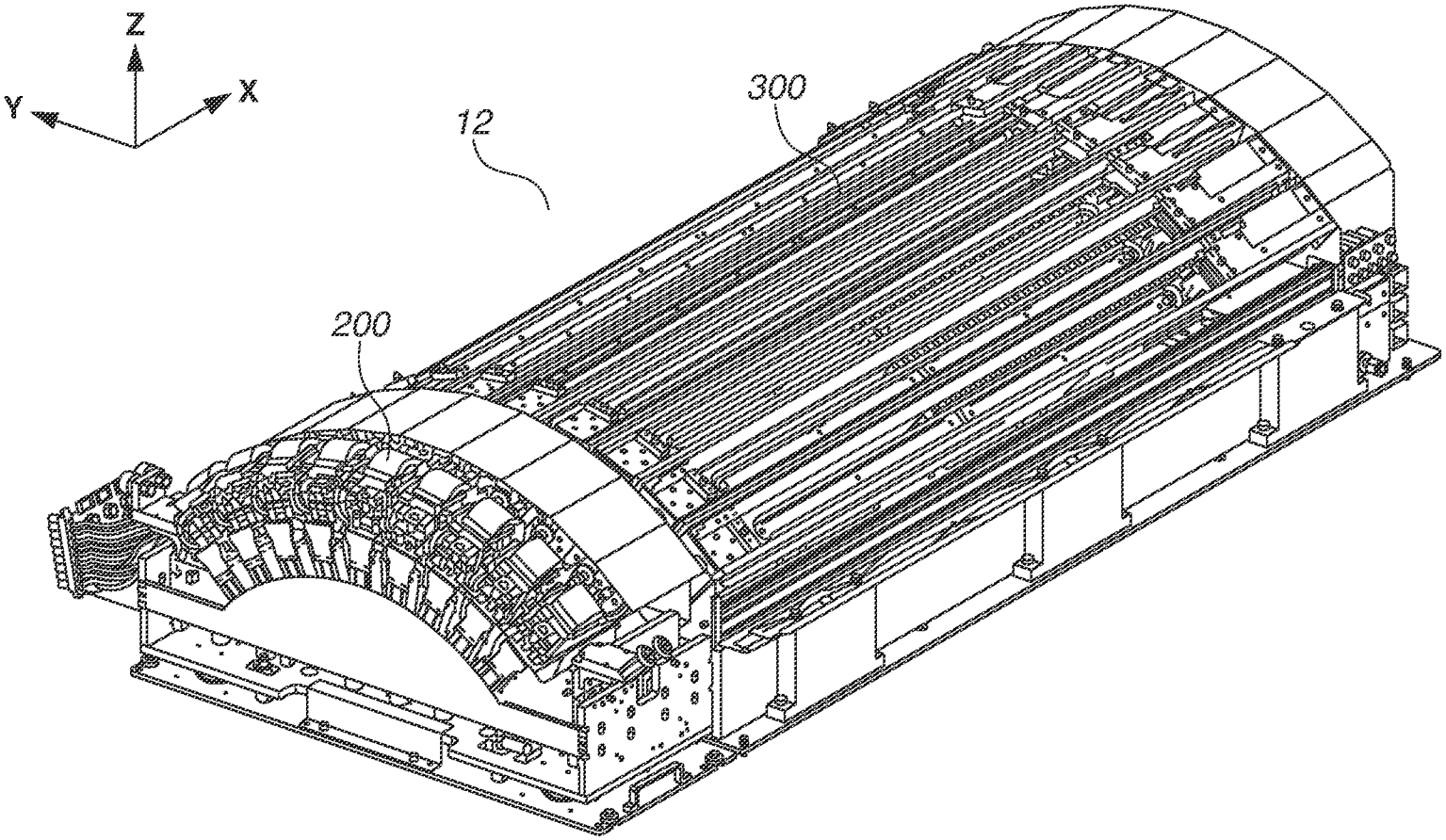
FIG. 8 is a top perspective view of a recovery unit of a recording apparatus according to the first exemplary embodiment.

The recovery unit 12 according to the present exemplary embodiment is described in detail. FIG. 8 is a top perspective view of the recovery unit 12. In the recovery unit 12, a cleaning unit 200 and an equalization unit 300 are arranged along the X-direction. The cleaning unit 200 and the equalization unit 300 are provided for each of the recording heads 30.

Figure 9A:
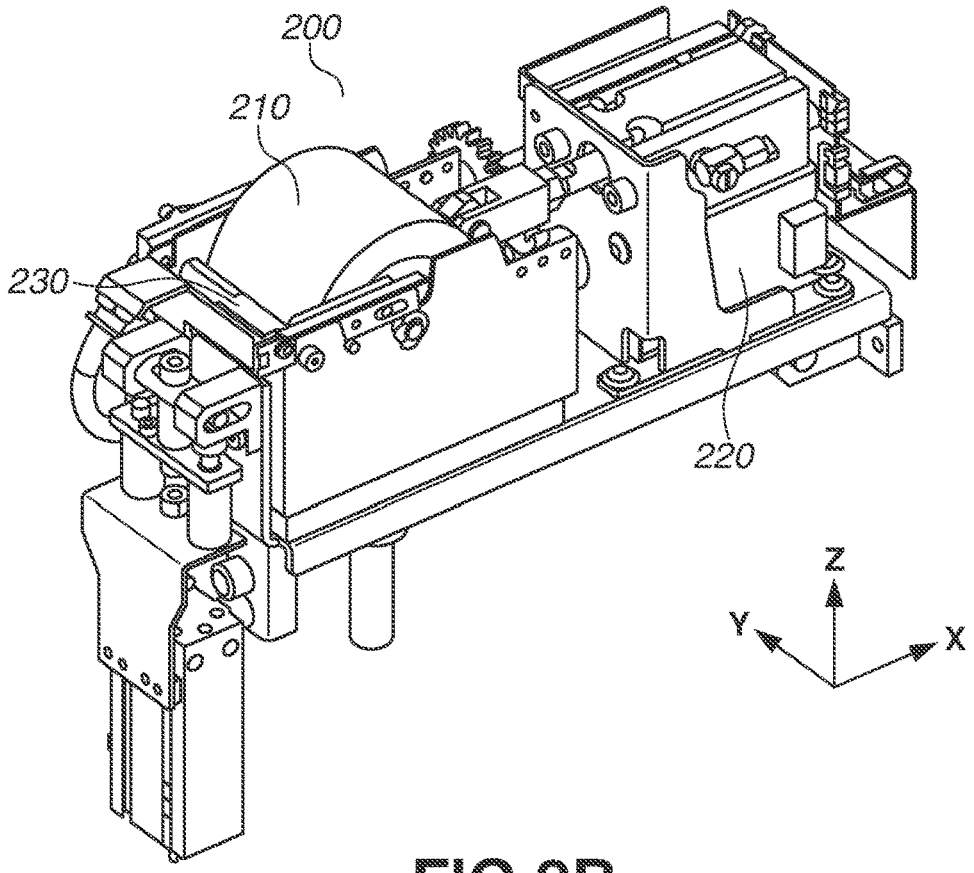
FIGS. 9A and 9B are top perspective views of a cleaning unit of the recording apparatus according to the first exemplary embodiment.
Figure 9B:
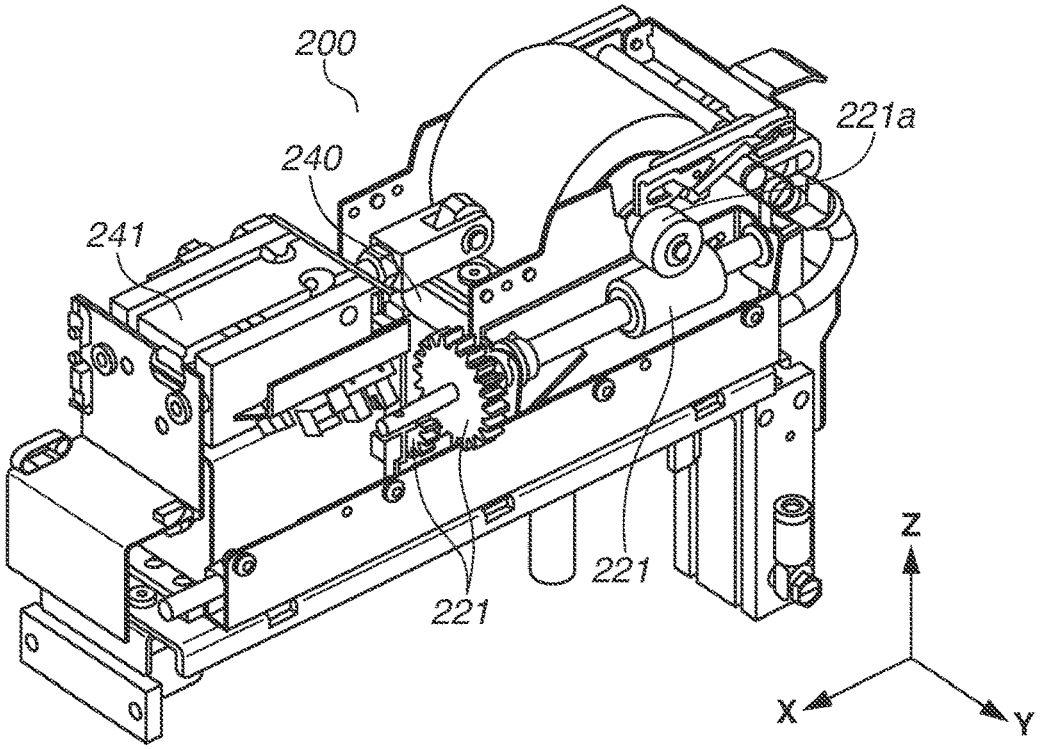

FIGS. 9A and 9B illustrate top perspective views of the cleaning unit 200. The cleaning unit 200 includes a cleaning roller 210 that rotates to apply a cleaning liquid to the ink discharge surface 33, a rotary motor 220 that rotates the cleaning roller 210, and a drive train 221 connected to the rotary motor 220. The cleaning unit 200 further includes a liquid application nozzle 230 that applies a liquid to the cleaning roller 210, a squeeze roller 240 that squeezes the cleaning roller 210, and an air cylinder 241 that causes the squeeze roller 240 to abut on the cleaning roller 210.

The cleaning roller 210 is obtained by assembling a cylindrical porous body having a predetermined thickness to a metal core roller composed of a resin or metal material. In the present exemplary embodiment, a polyurethane material having a thickness of 10 mm is used as the porous body. The porous body, however, is not limited to this material as long as the porous body satisfies functional conditions, such as a liquid contact property with respect to an ink and a cleaning liquid, a water retention capability, and cleaning performance. At one end in the axial direction of the metal core roller, a gear 221*a* for connecting to the drive train 221 is provided.

The cleaning roller 210 is configured to come into contact with the ink discharge surface 33 of the recording head 30 with a predetermined pressing force. In the present exemplary embodiment, the cleaning roller 210 is configured so that the pressing force is 0.5 to 1.0 kgf. The pressing force is appropriately set based on the cleaning conditions, the material of the cleaning roller 210, and the durability of a discharge surface of a head. More specifically, the contact between the cleaning roller 210 and the ink discharge surface 33 may be fine contact or contact with a pressing force exceeding 1.0 kgf, depending on conditions. The effect of some embodiments is not impaired in either way. The contact between the cleaning roller 210 and the ink discharge surface 33 may be managed not based on the pressing force, but based on an amount of penetration into the ink discharge surface 33 using the elastic force of the porous body. In this case, it is desirable that the amount of penetration be 5 to 20% of the thickness of the porous body. However, even if the amount of penetration is less than 5% or exceeds 20% of the thickness of the porous body, the effect of some embodiments is not impaired.

Figure 10A:
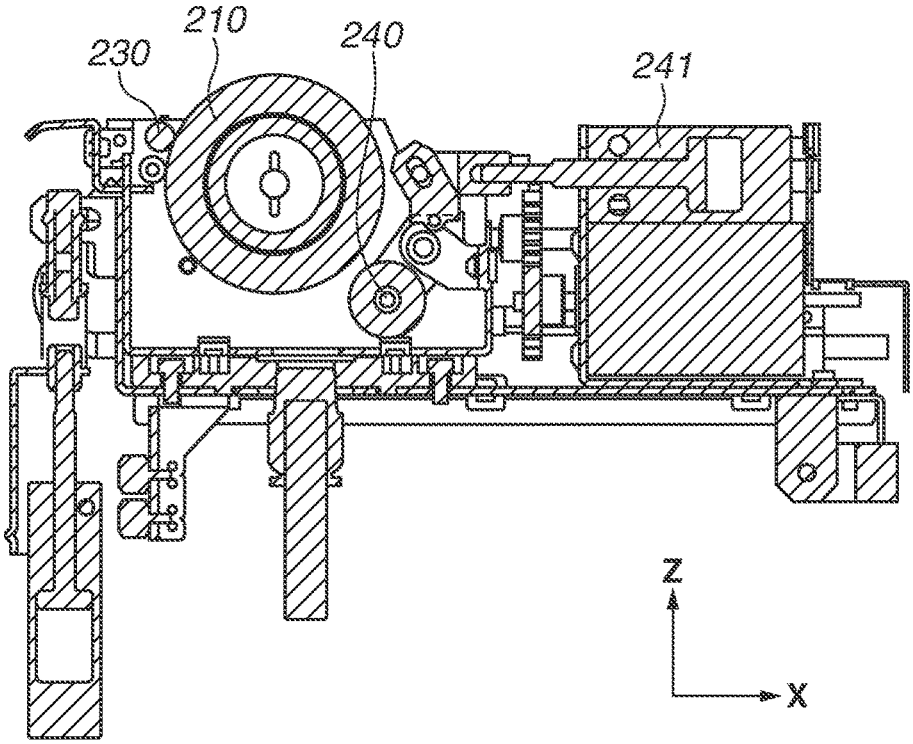
FIGS. 10A and 10B are transparent cross-sectional views of the cleaning unit of the recording apparatus according to the first exemplary embodiment.
Figure 10B:
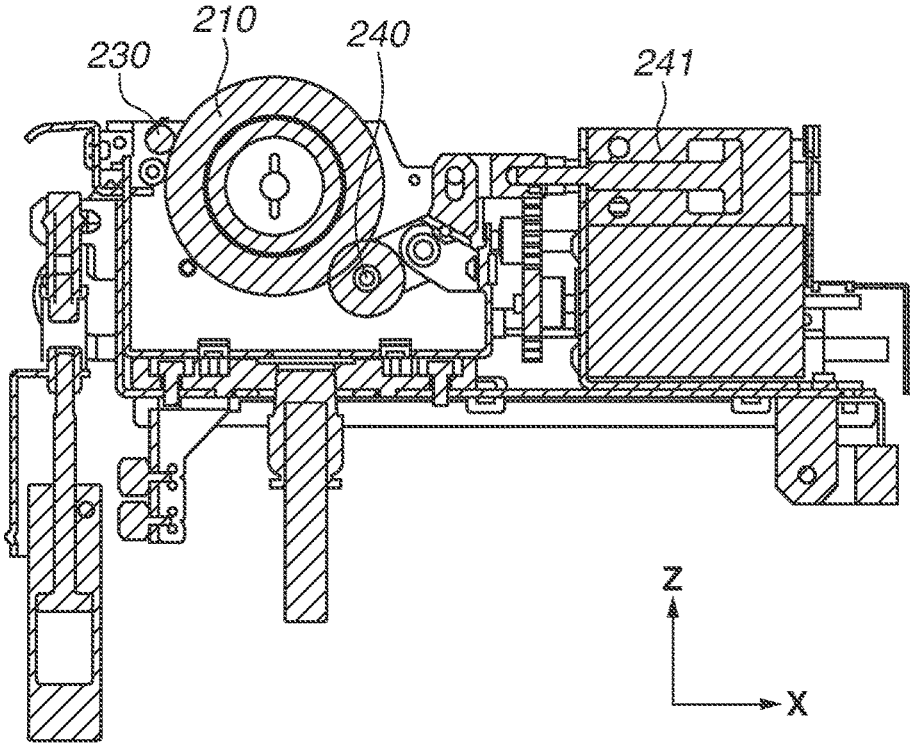

FIGS. 10A and 10B are transparent cross-sectional views of the cleaning unit 200 viewed from the Y-direction. The squeeze roller 240 is configured to squeeze out an excess of a liquid supplied to the cleaning roller 210, thereby maintaining the cleaning roller 210. The squeeze roller 240 is formed of a resin or metal material and is configured to rotate about a rotating shaft.

The squeeze roller 240 is not connected to the drive train 221, and is driven to rotate with rotation of the cleaning roller 210 in an operation described below. The squeeze roller 240, however, is not limited to the configuration in which the squeeze roller 240 is driven to rotate to obtain the effect of some embodiments. The rotating shaft is connected to the air cylinder 241 via a link and is configured to be capable of switching abutment and separation operations in the normal direction of the cleaning roller 210.

The amount of penetration of the squeeze roller 240 into the cleaning roller 210 is 50% of the thickness of the cleaning roller 210. The amount of penetration, however, can be set in a wide range from about 90% of the thickness of the cleaning member to almost 0%, which is a fine contact state. More specifically, the amount of penetration is a parameter that widely fluctuates depending on component members of the recording head 30 to be used, the ink composition, and the printing time. To squeeze the cleaning roller 210 more strongly, the amount of penetration is increased. The effect of some embodiments does not depend on the presence or absence of the squeeze roller 240. For example, in a case where the cleaning member is configured to be periodically replaced, the squeeze roller 240 may not be included.

The liquid application nozzle 230 applies a cleaning liquid to the cleaning roller 210 by sending the liquid by a pump from a liquid supply unit, which is separately configured. In the liquid application nozzle 230, six holes each having a diameter of about 0.3 mm are placed next to each other on the side surface of a cylindrical shape. The diameter of each hole is appropriately set in a range of about 0.1 to 1.5 mm based on viscosity and a supply amount of the liquid or the pressure loss in a path.

The cleaning liquid to be applied to the cleaning roller 210 is composed of a mixture of glycerin, an alkaline solvent, a surfactant, and water. Ratios of these components are determined based on the cleaning performance of fixed ink, the degree of sealing of a liquid tank, and the chemical resistance of the component members of the recording head 30. Regarding the type of mixture, the mixture may contain only water as long as conditions are satisfied. The type of mixture is not uniquely limited.

The operation of the cleaning unit 200 is described. The rotary motor 220 is driven to rotate the cleaning roller 210 via the drive train 221 and to cause the liquid application nozzle 230 to abut on the cleaning roller 210 and to cause the squeeze roller 240 to abut on the cleaning roller 210 by the driving of the air cylinder 241. These units only need to act simultaneously when the recording head 30 is actually cleaned, and thus, the order of operations does not matter.

The rotational direction of the cleaning roller 210 is set to the same direction as a relative moving direction relative to the recording head 30. The rotational velocity of the cleaning roller 210 is set so that a difference between the rotational velocity and a relative velocity relative to the recording head 30 is small. This is to reduce wear of both the recording head 30 (ink discharge surface 33) and the cleaning roller 210. To remove dirt on the ink discharge surface 33 more strongly, however, the rotational direction can also be set to a direction opposite to the relative moving direction.

Figure 11:
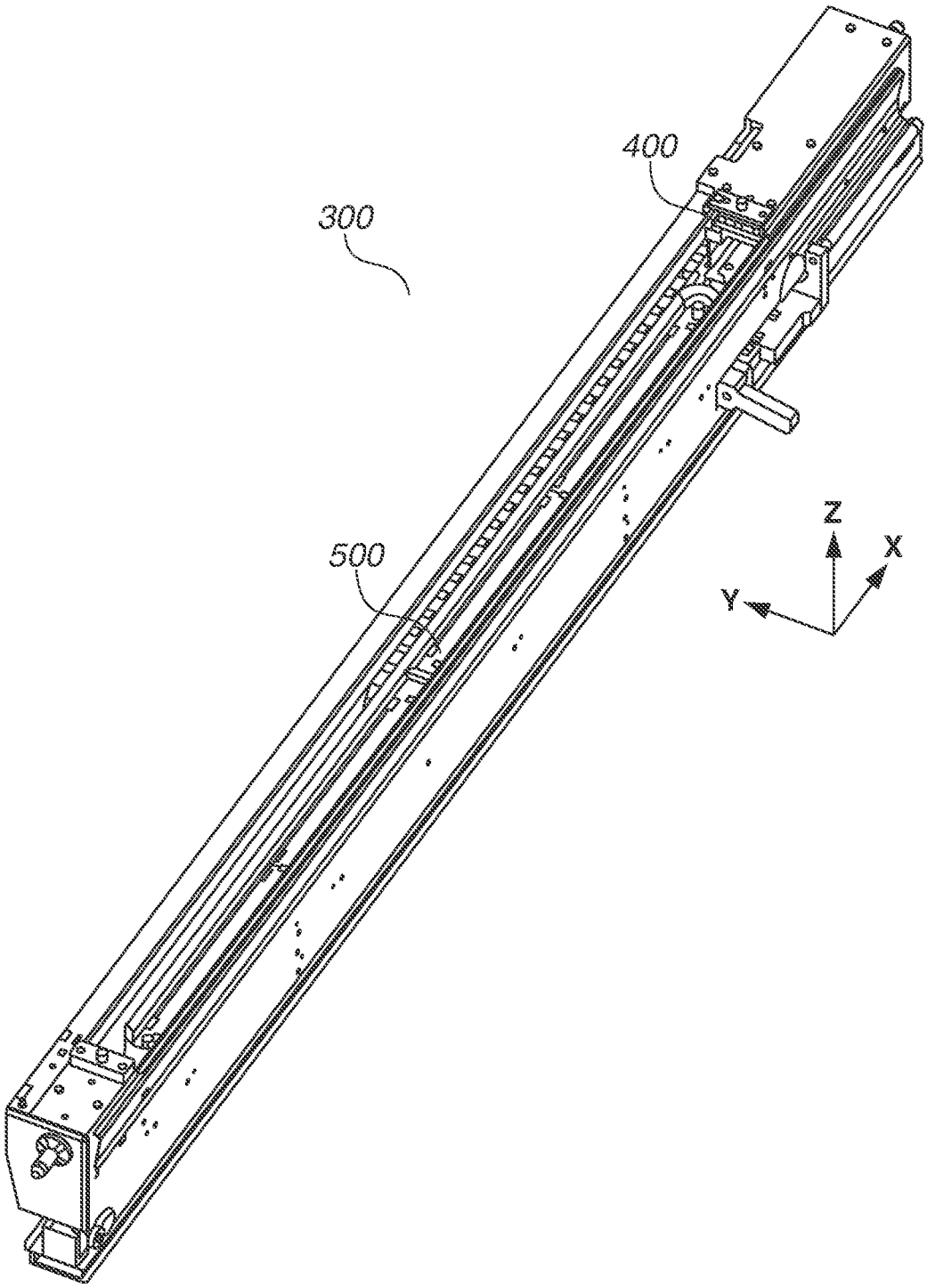
FIG. 11 is a top perspective view of an equalization unit of the recording apparatus according to the first exemplary embodiment.

FIG. 11 is a top perspective view of the equalization unit 300 for a single color of ink. The equalization unit 300 includes a suction wiping unit 400 and a cap unit 500 inside. The equalization unit 300 functions to position these units relative to the recording head 30. The equalization unit 300 is configured to, by a lifting and lowering mechanism (not illustrated), switch between the cap position POS5 where the equalization unit 300 caps the recording head 30, and the retracted position POS4, where the equalization unit 300 is retracted from the recording head 30.

Figure 12A:
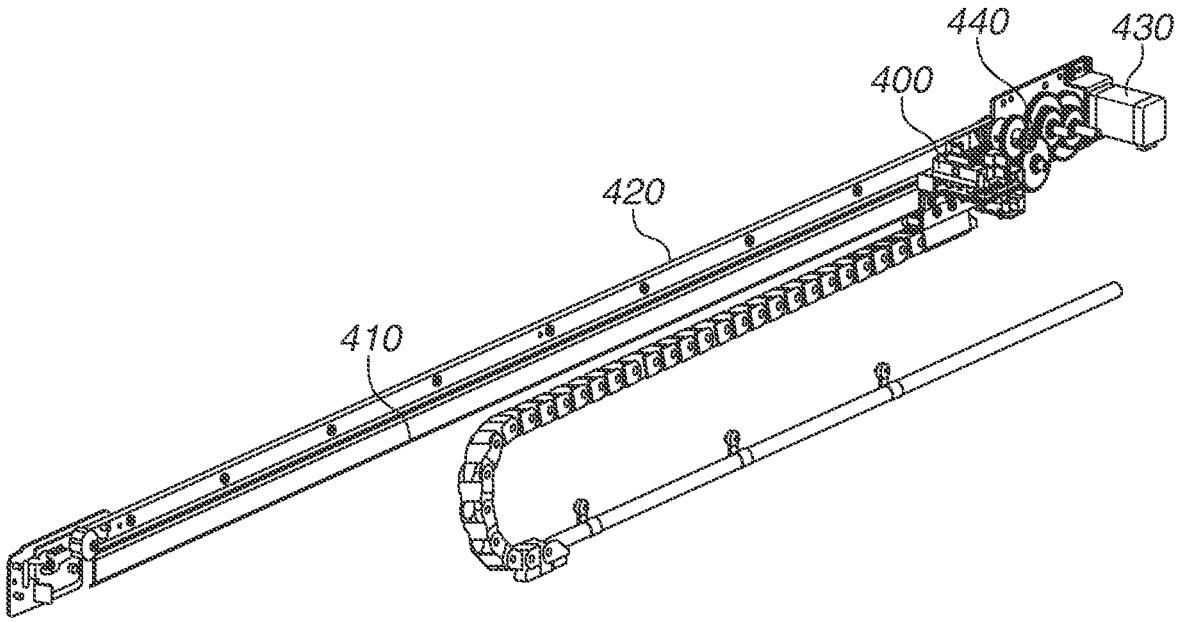
FIGS. 12A and 12B are top perspective views of a suction wiping unit of the recording apparatus according to the first exemplary embodiment.
Figure 12B:
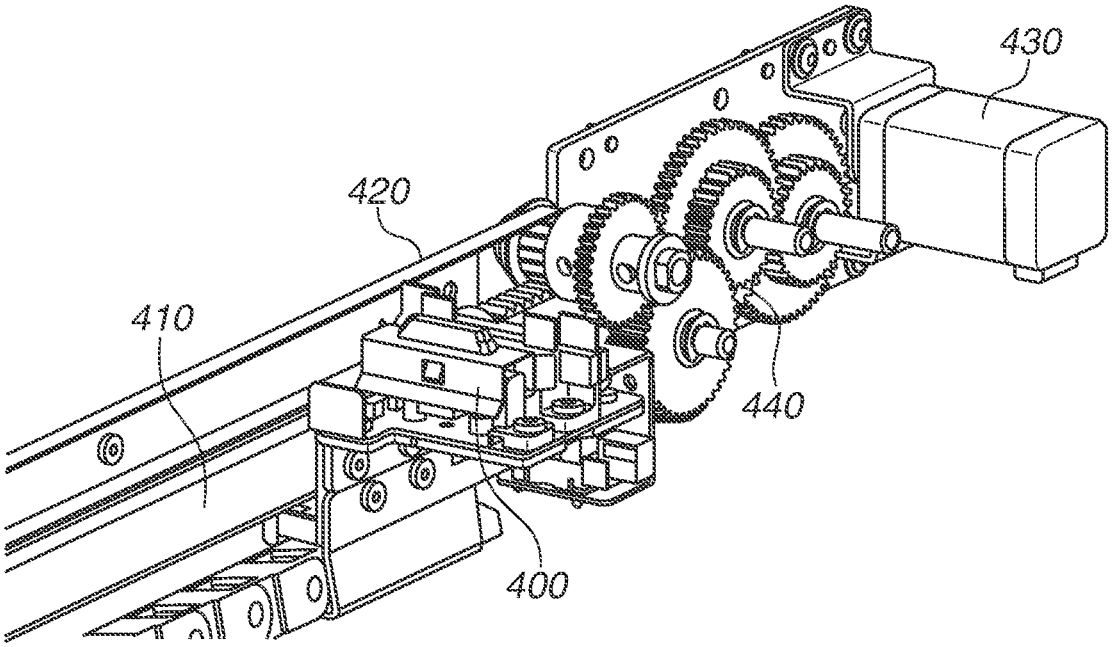

Inside the equalization unit 300, the suction wiping unit 400 is configured to be slidable, and the cap unit 500 is configured to be lifted and lowered. FIG. 12A is a perspective view illustrating a suction wiping unit driving portion for driving the suction wiping unit 400. FIG. 12B is an enlarged perspective view illustrating the vicinity of a driving motor 430. As illustrated in FIGS. 12A and 12B, the driving portion includes a driving rail 410 for sliding the suction wiping unit 400, a driving motor 430, a drive train 440, and a driving belt 420 for transmitting drive.

Figure 13:
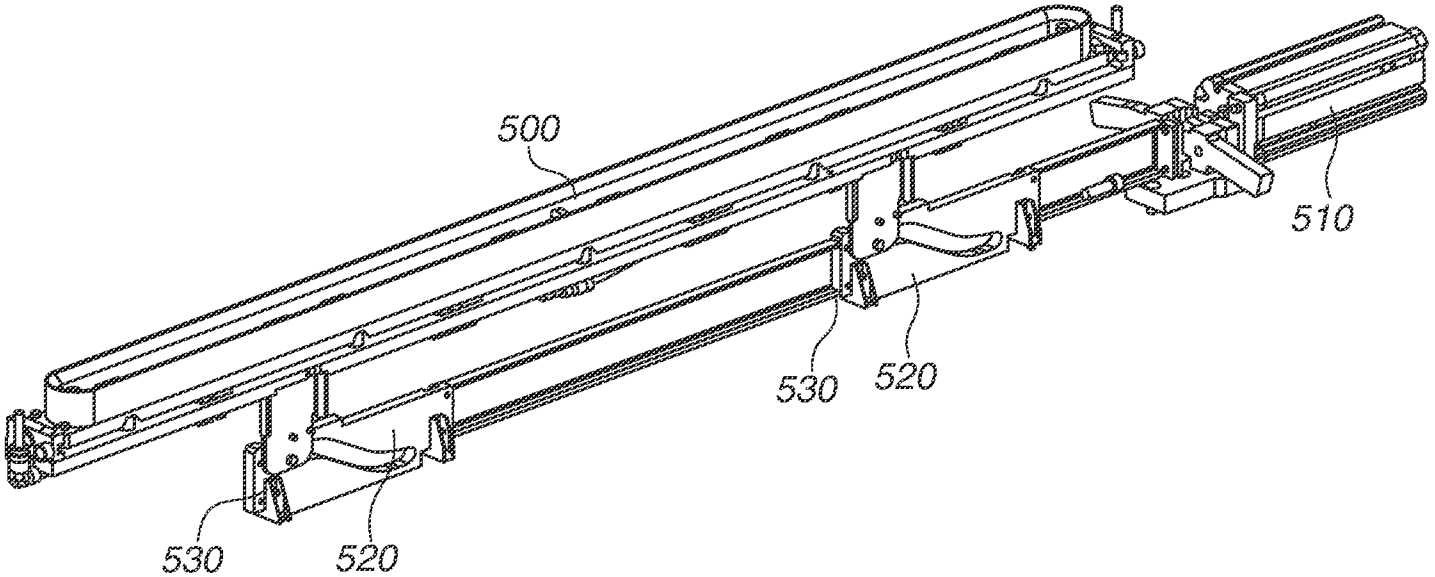
FIG. 13 is a top perspective view of a driving portion that drives a cap unit of the recording apparatus according to the first exemplary embodiment.

FIG. 13 is a perspective view illustrating a cap unit driving portion for driving the cap unit 500. The driving portion includes an air cylinder 510 that moves the cap unit 500 up and down, a cam 520 that operates by the air cylinder 510, and a cam follower 530 that engages with the cam 520.

Figure 14:
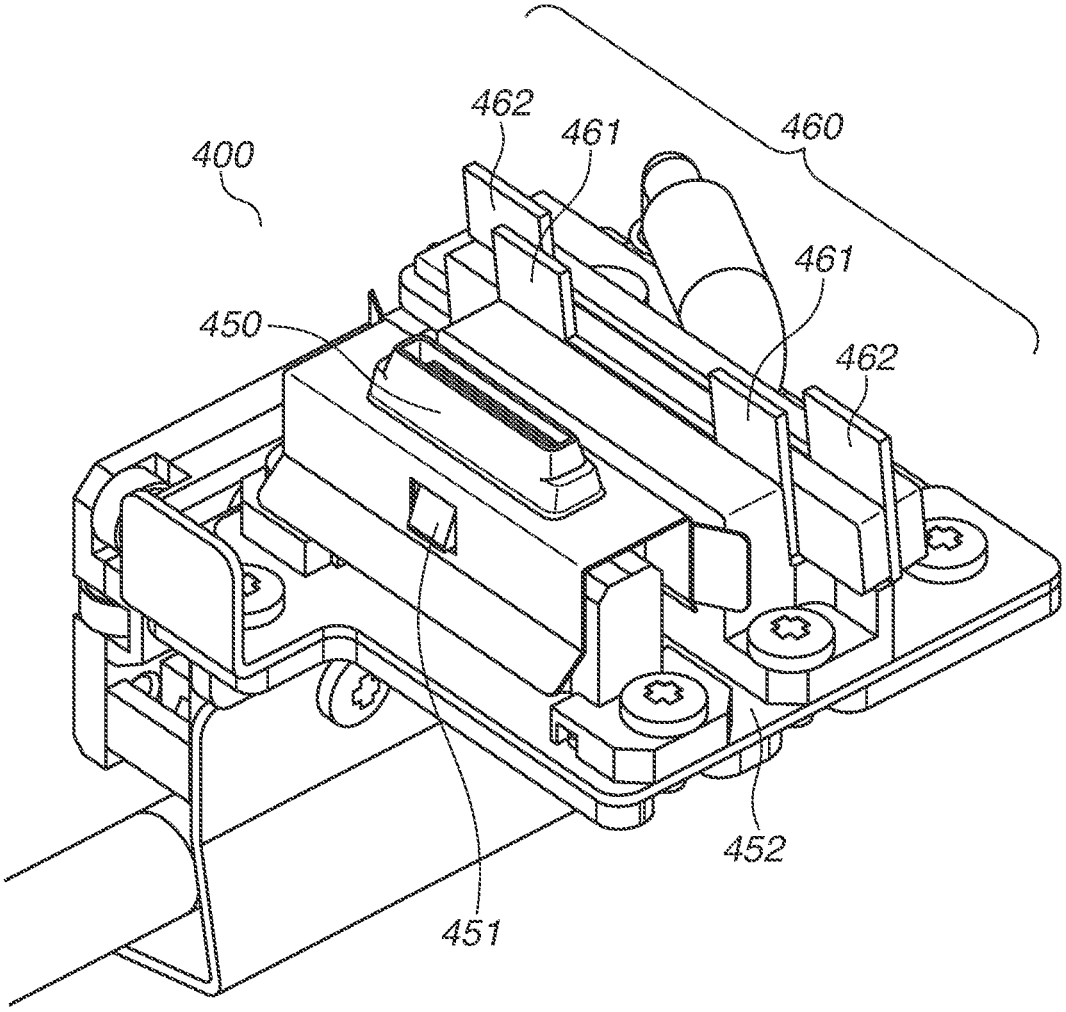
FIG. 14 is a top perspective view of the suction wiping unit of the recording apparatus according to the first exemplary embodiment.

FIG. 14 is a top perspective view illustrating the detailed configuration of the suction wiping unit 400. The suction wiping unit 400 includes a suction nozzle 450 that suctions an ink while wiping the ink by abutting on the ink discharge surface 33, a suction nozzle holder 451 that holds the suction nozzle 450, and a suction unit base 452. The suction nozzle 450 is connected to a suction pump (not illustrated) in a different unit via a tube.

The suction nozzle 450 is composed of a rubber-like elastic body. In the present exemplary embodiment, the suction nozzle 450 is composed of hydrogenated nitrile butadiene rubber (HNBR) having a Shore A hardness of 50±5. The material type and the hardness of the rubber-like elastic body, however, are not limited to obtain the effect of some embodiments as long as conditions, such as a liquid contact property with respect to an ink and a cleaning liquid, adhesiveness with a discharge nozzle surface, durability, and weather resistance, are satisfied. For example, urethane rubber, silicone rubber, ethylene propylene diene monomer rubber (EPDM), or fluoro rubber may be used.

The suction nozzle 450 is assembled to the suction nozzle holder 451. The suction nozzle holder 451 supports the suction nozzle 450 to maintain the shape of the suction nozzle 450, and further functions as a negative pressure path for generating negative pressure in the suction nozzle 450. However, in a case where the hardness of the material of the suction nozzle 450 is high, the suction nozzle holder 451 does not need to be configured to maintain the shape of the suction nozzle 450. In the middle of a path from the suction nozzle holder 451 to the suction pump, a valve and a pressure sensor are appropriately provided.

The suction nozzle holder 451 is attached to the suction unit base 452 so that the suction nozzle holder 451 can slide up and down. A spring pressing force is applied to the suction nozzle holder 451 in the upward direction. This is to increase adhesiveness and the capability to follow unevenness when the suction nozzle 450 comes into contact with the discharge nozzle surface. The suction unit base 452 is linked to the driving rail 410 so that the suction unit base 452 can slide in contact with the driving rail 410. The suction unit base 452 is also connected to the drive train 440 and the driving motor 430 via the driving belt 420.

As the suction pump, a diaphragm-type dry vacuum pump is employed. This is because a high degree of vacuum and a high flow rate are required to suck out a cleaning liquid having a higher viscosity than that of an ink from ink discharge nozzles. It is desirable that the vacuum pump be used in a state where a chemical solution does not flow into the vacuum pump. Thus, a gas-liquid separation configuration is included upstream of the vacuum pump. To obtain the effect of some embodiments, however, the form of the pump is not limited. A form in which a tube pump or a liquid diaphragm pump is used can also be employed as long as various conditions, such as the viscosity of the cleaning liquid and the shape of the ink discharge nozzles, are satisfied.

On the suction unit base 452, a blade 460 that wipes the outside of a discharge region of the ink discharge surface 33 is provided. More specifically, the discharge region of the ink discharge surface 33 is wiped and suctioned by the suction nozzle 450. The blade 460 is placed to wipe the ink discharge surface 33 subsequently to wiping by the suction nozzle 450 in wiping of the ink discharge surface 33 by the suction wiping unit 400. To follow unevenness of the recording head 30 (the ink discharge surface 33), the blade 460 includes a plurality of blades. In the present exemplary embodiment, two first blades 461 that wipe a protruding portion and two second blades 462 that wipe a portion other than the protruding portion are provided.

Figure 15A:
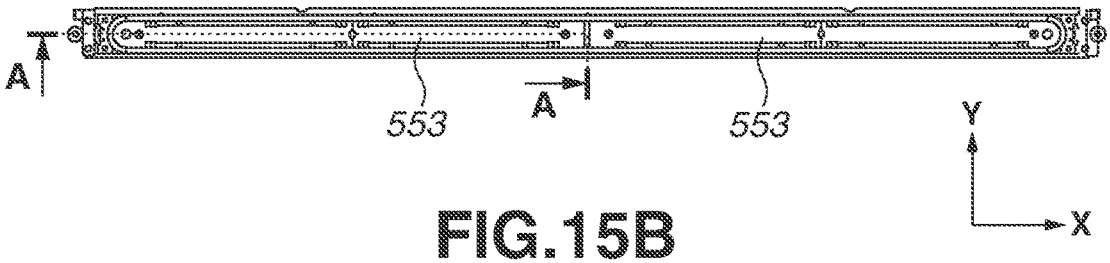
Figure 15B:
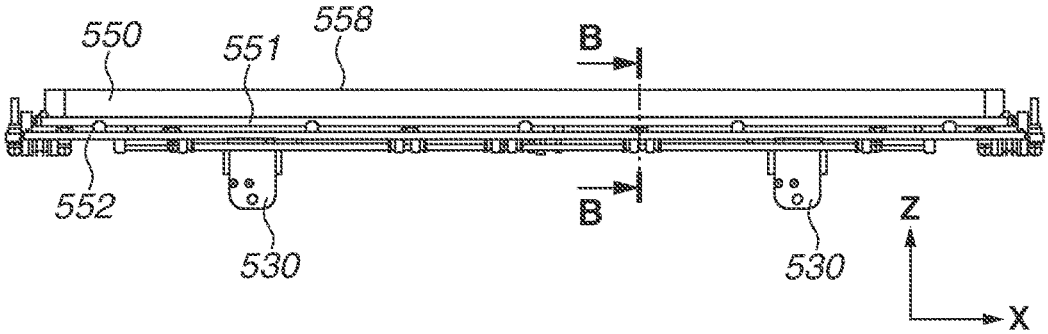
Figure 15C:
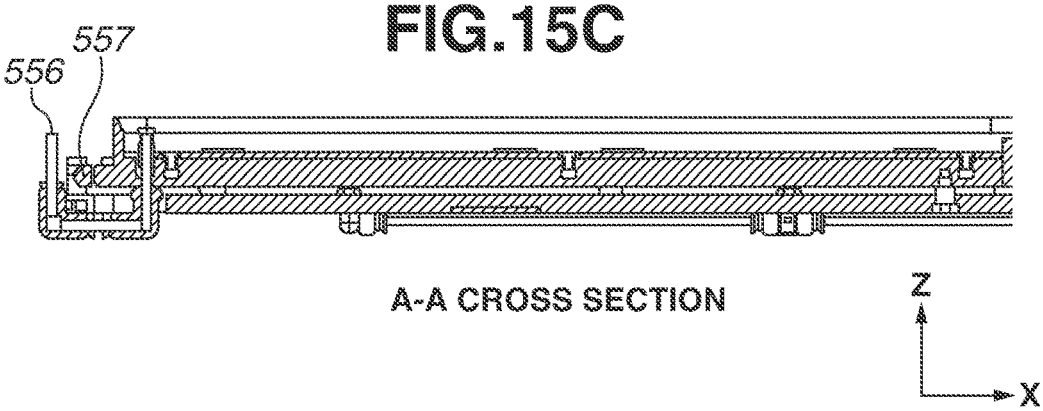
Figure 15D:
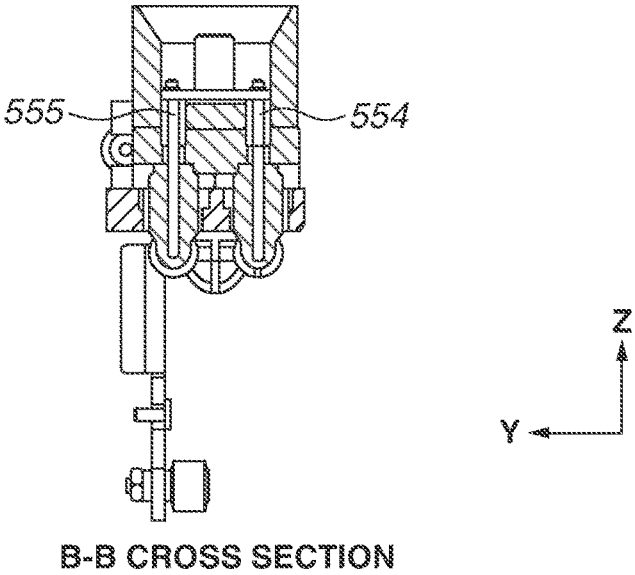

FIGS. 15A, 15B, 15C, and 15D are diagrams illustrating the detailed configuration of the cap unit 500. FIG. 15A is a top view of the cap unit 500. FIG. 15B is a cross-sectional view of the cap unit 500 as viewed from the Y-direction. FIG. 15C is an A-A cross-sectional view of FIG. 15A. FIG. 15D is a B-B cross-sectional view of FIG. 15B.

The cap unit 500 includes a cap 550 that caps the ink discharge surface 33, a cap holder 551 that holds the cap 550, and a cap holder base 552. The cap unit 500 further includes a cap absorber 553 disposed inside the cap 550, a cap cleaning liquid supply path 554, a liquid discharge path 555, and an atmosphere communication port 556 that causes the inside of the cap 550 to communicate with atmosphere.

The cap 550 is composed of a rubber-like elastic body. In the present exemplary embodiment, the cap 550 is composed of chlorinated butyl rubber having a Shore A hardness of 50±5. The cap 550 is incorporated into the cap holder 551, and the cap absorber 553 is laid inside the cap 550. The cap cleaning liquid supply path 554 and the liquid discharge path 555 extend in the longitudinal direction in contact with the cap absorber 553. Further, at both end portions in the longitudinal direction of the cap unit 500, the cap unit 500 includes the atmosphere communication port 556 that causes the inside of the cap 550 to communicate with atmosphere.

The cap holder 551 is attached to the cap holder base 552 so that the cap holder 551 can swing relative to the cap holder base 552. To swing means to perform a complex operation of an up-down movement and a rotational movement about a shaft 557 extending in the Y-direction. Swinging of the cap holder 551 is restricted by the pressing force of a spring placed between the cap holder 551 and the cap holder base 552. When the cap 550 comes into contact with the recording head 30 (the ink discharge surface 33), a rib surface 558 of the cap 550 uniformly comes into close contact with the ink discharge surface 33 by the swinging operation of the cap holder 551 and the action of spring pressure. This can prevent drying of the discharge ports formed on the ink discharge surface 33.

The cap holder base 552 is further connected to the cam follower 530 inside the equalization unit 300. The cam follower 530 is configured to be movable relative to the cam 520. The cam 520 is configured to slide by the air cylinder 510. In the cam 520, a groove in an oblique direction is formed, and the cam follower 530 moves inside the groove, thereby converting a slide operation of the air cylinder 510 in a lateral direction into an operation of the cap holder base 552 in the up-down direction.

As for the recovery unit 12, as many recovery units 12 as the number of recording heads 30 are provided. In the present exemplary embodiment, nine recovery units 12 corresponding to the nine recording heads 30 are provided.

The number of actuators that drive the units, however, is not necessarily equal to the number of the units. For example, in the present exemplary embodiment, one air cylinder 510 performs lifting and lowering operations of three cap units 500. The numbers can be flexibly changed depending on a scale of the apparatus and the number of recording heads 30, and is not limited thereto.

Next, a cleaning operation using the recovery unit 12 is described. FIG. 16 is a flowchart for selecting a cleaning mode after the recording operation ends. During the recording operation using each recording head 30, the reliability control unit 15C counts the number of times an ink is discharged from the discharge ports (hereinafter also referred to as a dot count value).

In S1601, the reliability control unit 15C determines whether the dot count value counted after the previous cleaning exceeds a predetermined dirt threshold. The dirt threshold is a value indicating a state where the ink discharge surface 33 is likely to be dirty by ink mist. For example, the dirt threshold is set based on an experimental value.

If the dot count value exceeds the dirt threshold (YES in S1601), then in S1602, the reliability control unit 15C executes a first cleaning mode. If, on the other hand, the dot count value does not exceed the dirt threshold (NO in S1601), then in S1603, the reliability control unit 15C executes a second cleaning mode.

FIG. 17 is a flowchart illustrating the first cleaning mode. A series of cleaning operations described below is all controlled by the reliability control unit 15C.

In S1701, the operation of the cleaning unit 200 is started, and the cleaning roller 210 cleans the ink discharge surface 33. In S1702, if the supply unit 6 performs an ink circulation operation, the circulation operation is stopped. This is to prevent a cleaning liquid having entered the discharge ports by the operation for cleaning from being mixed with an ink in an ink flow path by the ink circulation operation. The circulation operation, however, does not have to be stopped if the amount of cleaning liquid entering the discharge ports is an extremely minute amount with respect to an amount of ink held in the entire ink circulation flow path and is in a range that does not affect a completed recorded product.

In S1703, moving of the carriage 31 is started. FIGS. 19A, 19B, and 19C illustrate movements of the carriage 31 in the first cleaning mode and are diagrams schematically illustrating the right side surface of the recording system 1. In S1703, the carriage 31 is lifted to a cleaning position POS6, which is a position above the discharge position POS3 and below the retracted position POS4 in the Z-direction (FIG. 19A). The cleaning position POS6 is a position in the Z-direction for cleaning the ink discharge surface 33 by the cleaning unit 200.

Then, as illustrated in FIG. 19B, the carriage 31 moves from the discharge position POS1 to the cap position POS2 in the X-direction. Then, as illustrated in FIG. 19C, the carriage 31 is lowered in the Z-direction, thereby completing the movement to the cap position POS5.

In S1704, if it is confirmed that the carriage 31 has moved to the cap positions POS2 and POS5 (YES in S1704), then in S1705, the suction wiping unit 400 performs suction wiping. Specifically, inside the equalization unit 300, a retracting operation of the cap unit 500 is performed, and the suction wiping unit 400 moves to a wiping start position. Then, the equalization unit 300 positions the suction wiping unit 400 relative to the recording head 30.

Figure 20A:
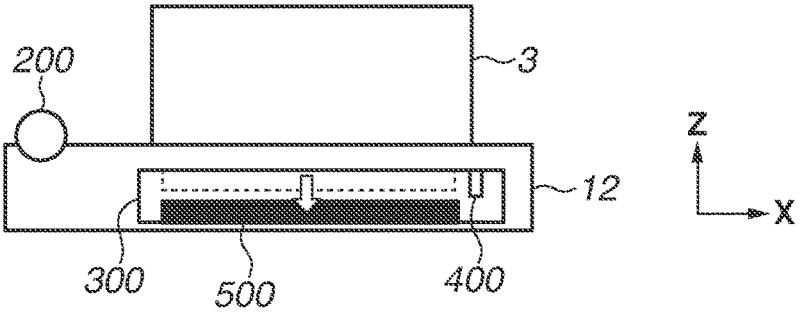
Figure 20B:
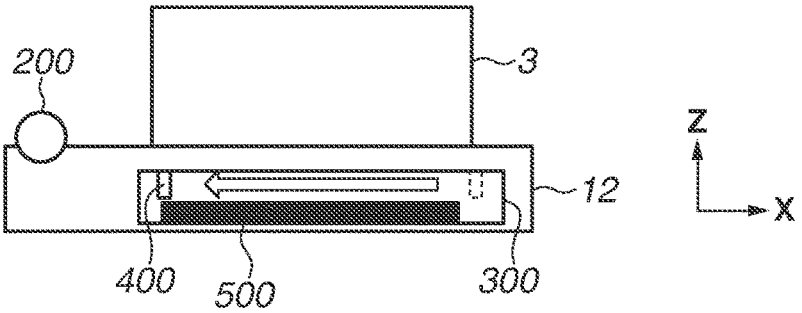
Figure 20C:
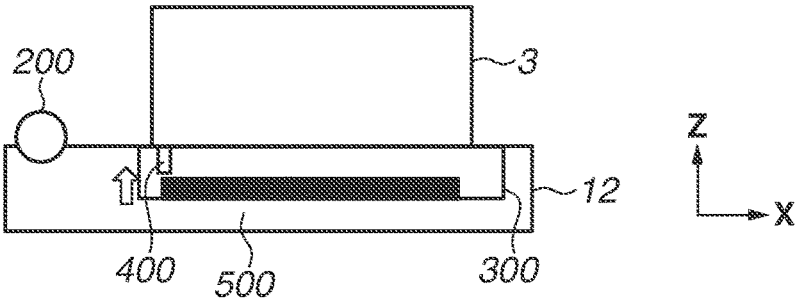

FIGS. 20A, 20B, 20C, and 20D are schematic side views illustrating movements of the suction wiping unit 400. FIG. 20A illustrates the retracting operation of the cap unit 500. FIG. 20B illustrates a state where the suction wiping unit 400 moves to the wiping start position. Then, as illustrated in FIG. 20C, the equalization unit 300 positions the suction wiping unit 400 relative to the recording unit 3 (the recording head 30).

Figure 20D:
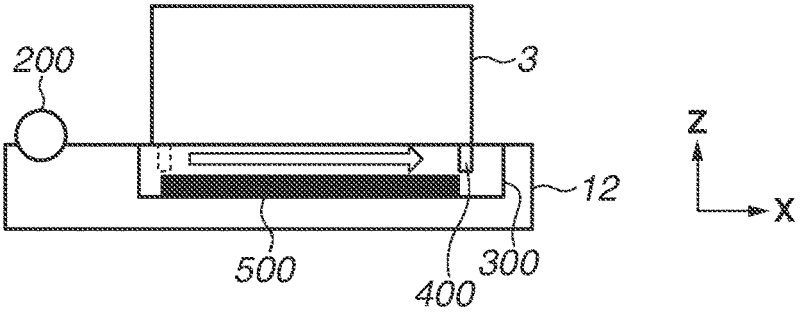

After the suction pump starts suction, then as illustrated in FIG. 20D, the suction wiping unit 400 moves from the wiping start position to a wiping end position. In the present exemplary embodiment, a standby position (a home position) of the suction wiping unit 400 is in the rear of the recording apparatus 1A. Thus, the scanning direction of the suction wiping unit 400 is a direction from the front to the rear of the recording apparatus 1A, i.e., a direction from upstream to downstream in the X-direction.

After the suction wiping ends, then in S1706, the cap unit 500 is lifted up, and the ink discharge surface 33 of the recording head 30 is capped with the cap 550. In S1707, it is determined whether a preliminary discharge operation is necessary. If the preliminary discharge operation is necessary (YES in S1707), then in S1708, the recording head 30 discharges an ink to the cap 550. The preliminary discharge operation is performed, for example, in a case where required conditions are satisfied for the purpose of refreshing a heater provided in the ink discharge nozzles or detecting a discharge failure. If the preliminary discharge operation is executed, a liquid discharge operation for discharging a liquid from the liquid discharge path 555 provided in the cap 550 is also performed, thereby the ink discharged into the cap 550 is discharged. Further, after the preliminary discharge operation ends, it is desirable to periodically supply a cap cleaning liquid from the cap cleaning liquid supply path 554 and clean the cap absorber 553.

Next, with reference to FIG. 18, the second cleaning mode is described. In the second cleaning mode, unlike the first cleaning mode, the cleaning unit 200 does not perform cleaning. In other words, the second cleaning mode is the mode of performing a cleaning operation weaker than that in the first cleaning mode.

In S1801, the carriage 31 is lifted in the Z-direction, thereby moving from the discharge position POS3 to the retracted position POS4. Then, the carriage 31 moves from the discharge position POS1 to the cap position POS2 in the X-direction. Further, the carriage 31 is lowered to the cap position POS5 in the Z-direction (see FIG. 3). In S1802, if it is confirmed that the carriage 31 has moved to the cap positions POS2 and POS5 (YES in S1802), then in S1803, the suction wiping unit 400 performs suction wiping. This operation is similar to that in the first cleaning mode. Then, in 51804 to S1806, operations similar to those in S1706 to S1708 in the first cleaning mode are performed.

As described above, in the present exemplary embodiment, the cleaning unit 200 applies a cleaning liquid to the ink discharge surface 33, and then, the suction wiping unit 400 suctions the cleaning liquid. Consequently, even if the cleaning liquid is pushed into the discharge ports, the cleaning liquid can be discharged to the outside by suction wiping. Thus, it is possible to prevent a reduction in image quality due to mixing of the cleaning liquid with an ink discharged from the recording head 30. The present exemplary embodiment is effective particularly because it is possible to prevent the cleaning liquid from being mixed in a circulation flow path in a form in which inks are circulated between the storage portions TK and the recording heads 30.

Further, whether to apply the cleaning liquid in the cleaning operation for cleaning the recording head 30 is switched based on the dot count value. More specifically, the recording apparatus 1A according to the present exemplary embodiment can execute the first cleaning mode where the cleaning liquid is applied, and the second cleaning mode where the cleaning liquid is not applied. Consequently, the cleaning liquid is not applied to the ink discharge surface 33 when not necessary. Thus, it is possible to prevent a reduction in image quality due to the mixing of the cleaning liquid into the discharge ports.

In the first exemplary embodiment, the form is employed in which the recording unit 3 includes the plurality of recording heads 30. Alternatively, a form may be employed in which the recording unit 3 includes only one recording head 30. Yet alternatively, each recording head 30 can employ a serial method for discharging an ink while moving in a direction intersecting the conveying direction of the recording medium P, instead of being a full-line head.

A conveying mechanism for conveying the recording medium P may be a method of nipping and conveying the recording medium P by a roller pair. In the method of conveying the recording medium P by the roller pair, a form may be employed in which a roll sheet is used as the recording medium P, and the roll sheet is cut after transfer, thereby the recorded product P' is produced. Further, in the first exemplary embodiment, the transfer member 2 is provided on the outer circumferential surface of the transfer cylinder 41. Alternatively, a method may be employed in which the transfer member 2 is formed into an endless belt that is caused to cyclically run.

In the first exemplary embodiment, the cleaning roller 210 is used as an application unit that applies a cleaning liquid to the ink discharge surface 33, but a shape of the application unit is not limited to a roller shape. The effect of some embodiments can also be obtained by the application unit having a block shape or a web shape using a woven fabric or a non-woven fabric. In the operation of the application unit having the block shape, the application unit may be moved relative to the ink discharge surface 33 in the state where the application unit is in contact with the ink discharge surface 33, or may perform a stamp-like operation by combining an up-down movement and a relative movement. In the operation of the application unit having the web shape using a woven fabric or a non-woven fabric, a rectangular material may be moved in a direction similar to the relative moving direction to bring a relative velocity relative to the discharge nozzle surface infinitely close to zero, similarly to the operation of the application unit having the roller shape, or the rectangular material may be moved in a direction opposite to the relative moving direction, thereby proactively scraping dirt. Alternatively, a backup member formed of an elastic body may be provided to increase adhesiveness to the ink discharge surface 33.

As the form of supplying a cleaning liquid, the liquid application nozzle is employed in the first exemplary embodiment, but is not limited thereto. A form may be employed in which a cleaning liquid stored in a liquid tank is drawn up by a method suitable for each form. In the case of a roller form, a liquid may be supplied from inside via a seal bearing using a shaft having a hollow path that communicates with a cleaning member.

Regarding the form of removing an excessive cleaning liquid, the squeeze roller is employed in the present exemplary embodiment, but is not limited thereto. For example, the excessive cleaning liquid may be blown away by air blow, or may be removed by suction. The liquid may be removed by pressing a material having a strong capillary force against the liquid.

OTHER EMBODIMENTS

Some embodiments can also be realized by a computer of a system or apparatus that reads out and executes computer-executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer-executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer-executable instructions. The computer-executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has described exemplary embodiments, it is to be understood that some embodiments are not limited to the disclosed exemplary embodiments. The scope of the following claims is to be accorded the broadest interpretation so as to encompass all such modifications and equivalent structures and functions.

This application claims priority to Japanese Patent Application No. 2020-197647, which was filed on Nov. 27, 2020 and which is hereby incorporated by reference herein in its entirety.

What is claimed is:

1. A maintenance apparatus comprising:

an application unit configured to come into contact with a discharge surface, on which discharge ports configured to discharge a liquid are provided, included in a recording head and apply a cleaning liquid to the discharge surface by a relative movement of the application unit and the recording head;

a suction unit configured to suction the liquid from the discharge ports by moving along the recording head; and a control unit configured to execute a first cleaning mode where, after the application unit applies the cleaning liquid, the suction unit suctions the liquid from the discharge ports in a state where the application unit does not apply the cleaning liquid.

2. The maintenance apparatus according to claim 1, wherein the control unit executes a second cleaning mode where the application unit does not apply the cleaning liquid before the suction unit suctions the liquid from the discharge ports.

3. The maintenance apparatus according to claim 2, wherein, based on the number of times the liquid is discharged from the recording head after previous cleaning, the control unit selects which of the first and second cleaning modes is to be executed.

4. The maintenance apparatus according to claim 3, wherein, in a case where the number of times the liquid is discharged exceeds a threshold, the control unit executes the first cleaning mode and, in a case where the number of times the liquid is discharged does not exceed the threshold, the control unit executes the second cleaning mode.

5. The maintenance apparatus according to claim 1, wherein the application unit includes a roller configured to rotate.

6. A recording apparatus comprising:

a recording head including a discharge surface on which discharge ports configured to discharge a liquid are provided;

an application unit configured to come into contact with the discharge surface and apply a cleaning liquid to the discharge surface by a relative movement of the application unit and the recording head;

a suction unit configured to suction the liquid from the discharge ports by moving along the recording head;

a control unit configured to execute a first cleaning mode where, after the application unit applies the cleaning liquid, the suction unit suctions the liquid from the discharge ports in a state where the application unit does not apply the cleaning liquid.

7. The recording apparatus according to claim 6, wherein the control unit executes a second cleaning mode where the application unit does not apply the cleaning liquid before the suction unit suctions the liquid from the discharge ports.

8. The recording apparatus according to claim 7, wherein based on the number of times the liquid is discharged from the recording head after previous cleaning, the control unit selects which of the first and second cleaning modes is to be executed.

9. The recording apparatus according to claim 8, wherein, in a case where the number of times the liquid is discharged exceeds a threshold, the control unit executes the first cleaning mode and, in a case where the number of times the liquid is discharged does not exceed the threshold, the control unit executes the second cleaning mode.

10. The recording apparatus according to claim 6, wherein the application unit includes a roller configured to rotate.

11. The recording apparatus according to claim 6, wherein, after the suction unit suctions the liquid from the discharge ports, the control unit causes the recording head to preliminarily discharge the liquid.

12. The recording apparatus according to claim 6, further comprising:

a storage portion configured to store a liquid to be supplied to the recording head; and a circulation unit configured to circulate the liquid between the recording head and the storage portion.

13. The recording apparatus according to claim 6, wherein the recording head is a line head in which the discharge ports are provided in a range corresponding to a width of a recording medium.

14. The recording apparatus according to claim 6, wherein a plurality of the recording head are provided for each ink color.

15. The recording apparatus according to claim 6, wherein the application unit and the suction unit are provided for each ink color.

16. A control method comprising:

recording an image using a recording head including a discharge surface on which discharge ports configured to discharge a liquid are provided;

applying a cleaning liquid using an application unit to the discharge surface by contacting with the discharge surface and by a relative movement of the application unit and the recording head;

suctioning the liquid from the discharge ports by moving a suction unit along the recording head; and executing a first cleaning mode where, after the applying the cleaning liquid, the suction unit suctions the liquid from the discharge ports in a state where the application unit does not apply the cleaning liquid.

17. The control method according to claim 16, further comprising executing a second cleaning mode where the applying the cleaning liquid is not executed before the suction unit suctions the liquid from the discharge ports.

18. The control method according to claim 17, further comprising selecting which of the first and second cleaning modes is to be executed.

* * * * *